US008090111B2

(12) United States Patent
Aichner et al.

(10) Patent No.: US 8,090,111 B2
(45) Date of Patent: Jan. 3, 2012

(54) SIGNAL SEPARATOR, METHOD FOR DETERMINING OUTPUT SIGNALS ON THE BASIS OF MICROPHONE SIGNALS, AND COMPUTER PROGRAM

(75) Inventors: Robert Aichner, Geiselhöring (DE); Herbert Buchner, Nittendorf (DE); Walter Kellermann, Eckental (DE)

(73) Assignees: Siemens Audiologische Technik GmbH, Erlangen (DE); Friedrich-Alexander-Universität Erlangen-Nürnberg, Erlangen (DE)

( * ) Notice: Subject to any disclaimer, the term of this patent is extended or adjusted under 35 U.S.C. 154(b) by 467 days.

(21) Appl. No.: 12/308,284

(22) PCT Filed: Jun. 12, 2007

(86) PCT No.: PCT/EP2007/005182
§ 371 (c)(1),
(2), (4) Date: Dec. 11, 2008

(87) PCT Pub. No.: WO2007/144147
PCT Pub. Date: Dec. 21, 2007

(65) Prior Publication Data

US 2010/0232621 A1 Sep. 16, 2010

(30) Foreign Application Priority Data

Jun. 14, 2006 (DE) ..... 10 2006 027 673

(51) Int. Cl.
*H04R 29/00* (2006.01)

(52) U.S. Cl. ..... 381/56; 381/92; 381/94.1; 381/94.2

(58) Field of Classification Search ..... 381/56, 381/92, 94.1, 94.2
See application file for complete search history.

(56) References Cited

U.S. PATENT DOCUMENTS

| | | | | |
|---|---|---|---|---|
| 5,539,832 | A * | 7/1996 | Weinstein et al. | 381/94.1 |
| 6,130,949 | A | 10/2000 | Aoki et al. | |
| 2006/0140417 | A1 * | 6/2006 | Zurek | 381/92 |
| 2010/0070274 | A1 * | 3/2010 | Cho et al. | 704/233 |

FOREIGN PATENT DOCUMENTS

| | | |
|---|---|---|
| EP | 1 070 390 B1 | 1/2001 |
| WO | WO 2004/006624 A1 | 1/2004 |
| WO | WO 2006/012578 A1 | 2/2006 |

OTHER PUBLICATIONS

A. Hyvärinen, J. Harhunen and E. Oja, *Independent Component Analysis*, Wiley & Sons, New York, 2001.
L. Parra and C. Spence, *Convolutive Blind Source Separation of Non-stationary Sources*, IEEE Trans. Speech an Audio Processing, pp. 320-327, May 2000.
H. Buchner, R. Aichner and W. Kellermann, *Blind Source Sepaaration for Convolutive Mixtures: A Unified Treatment*, in Y. Huang, J. Benesty (editors) *Audio Signal Processing*, Kluwer Academic Publishers, Boston, 2004.

(Continued)

*Primary Examiner* — Wai Sing Louie

(57) ABSTRACT

A signal separator, a method and computer product for determining a first output signal describing an audio content of a useful-signal source in a first microphone signal, and for determining a second output signal describing an audio content of the useful-signal source in a second microphone signal.

11 Claims, 9 Drawing Sheets

OTHER PUBLICATIONS

T. Hoya, T. Tanaka, A. Cichicki, T. Murakami, G. Hori and J. Chambers, *Stereophonic Noise Reduction Using a Combined Sliding Subspace Projection an Adaptive Signal Enhancement*, IEEE Trans. Speech an Audio Processing, vol. 13, No. 3, pp. 309-320, May 2005.
J. Allen and D. Berkley, *Image Method for Efficiently Simulating Small-Room Acoustics*, J. Acoust. Soc. Am., pp. 943-950, 1979.
J. Garas, *Adaptive 3D Sound Systems*, Kluwer Academic Publishers, 2000.
Herbert Buchner, Robert Aichner and Walter Kellermann, Relation between Blind System Identification and Convolutive Blind Source Separation, Hands-free Speech Communication and Microphone Arrays Workshop, Piscataway, NJ, USA, 2005.
Herbert Buchner, Robert Aichner, Jochen Stenglein, Heinz Teutsch and Walter Kellermann, *Simultaneous Localization of Multiple Sound Sources using Blind Adaptive MIMO Filtering*, Proc. IEEE Int. Conf. on Acoustics, Speech, and Signal Processing (ICASSP), Philadelphia, USA, Mar. 2005.
R. Martin, *Noise Power Spectral Density Estimation Based on Optimal Smoothing and Minimum Statistics*, IEEE Trans. Speech and Audio Processing, vol. 9, No. 5, pp. 504-512, Jul. 2001.
S. Haykin, Adaptive Filter Theory, 4th edition, Prentice-Hall, 2002.
T. Takatani, T. Nishikawa, H. Saruwatari and K. Shikano, *High-Fidelity Blind Separation of Acoustic Signals using SIMO-Model-Based ICA with Information-Geometric Learning*, Proc. Int. Workshop on Acoustic Echo and Noise Control (IWAENC), Sep. 2003, Kyoto, Japan.
K. Matsuoka and S. Nakshima, *Minimal Distortion Principle for Blind Source Separation*, Proc. Int. Conf. on Independent Component Analysis and Blind Signal Separation, Dec. 2001, San Diego, CA, USA.
T. J. Klasen, M. Moonen, T. Van Den Bogaert and J. Wouters, "*Preservation of interaural time delay for binaural hearing aids through multi-channel Wiener filtering based noise reduction*", Proc. IEEE Int. Conf. on Acoustics, Speech, and Signal Processing (ICASSP), Philadelphia, USA, Mar. 2005.
W. Herbordt, F. Nakamura, W. Kellermann "Multi-channel estimation of power spectral density of noise for mixtures of non-stationary signals", IPSJ SIG Technical Reports, vol. 2004, No. 131, pp. 211-216, Kyoto, Japan, Dec. 2004.
W. Herbordt. T. Trini, W. Kellermann "Robust spatial estimation of the signal-to-interference ratio for non-stationary mixtures", Proc. Int. Workshop on Acoustic Echo and Noise Control, pp. 247-250, Kyoto, Japan, Sep. 2003.
Herbert Buchner, Robert Aichner, Walter Kellermann "Trinicon: A Versatile Framework for Multichannel Blind Signal Processing", Proc. IEEE Int. Conf. on Acoustics, Speech and Signal Processing (ICASSP), pp. 889-892, vol. 3, Montreal, Canada, May 2004.
S. Ikeda, N. Murata, "A method of ICA in time-frequency domain", in Proc. Int. Symposium on Independent Component Analysis and Blind Signal Separation, pp. 365-371, Aussois, France, Jan. 1999.
Siow Yong Low et al, "A hybrid speech enhancement system employing blind source separation and adaptive noise cancellation"; Signal Processing Symposium, 2004. NORSIG 2004; Proceedings of the 6$^{th}$ NORDIC ESP00, Finland; Jun. 9-11, 2004; Piscataway, NJ, pp. 204-207; ISBN 951-22-7065-X.
Nguyen Thi H L et al; "Speech Enhancement: Analysis and Comparison of Methods on Various Real Situations"; Signal Processing Theories and Applications. Brussels, Aug. 24-27, 1992; Proceedings of the European Signal ProCessing-Conference (EUSIPCO0, Amsterdam, Elsevier, NL. vol. 1 Conf 6, Aug. 24, 1992, pp. 303-306, XP000348664, ISBN: 0-444-89587-6.
Mukai et al., "Real Time Blind Source Separation and DOA Estimation Using Small 3-D Microphone Array", 2005 International WOrkshop on Acoustic Echo and Noise Control, Sep. 12-15, 2005, pp. 45-48.
A. Hyvärinen, J. Harhunen and E. Oja, Independent Component Analysis, Wiley & Sons, New York, 2001.
L. Parra and C. Spence, Convolutive Blind Source Separation of Non-stationary Sources, IEEE Trans. Speech an Audio Processing, pp. 320-327, May 2000.
H. Buchner, R. Aichner and W. Kellermann, Blind Source Sepaaration for Convolutive Mixtures: A Unified Treatment, in Y. Huang, J. Benesty (editors) Audio Signal Processing, Kluwer Academic Publishers, Boston, 2004.
T. Hoya, T. Tanaka, A. Cichicki, T. Murakami, G. Hori and J. Chambers, Stereophonic Noise Reduction Using a Combined Sliding Subspace Projection an Adaptive Signal Enhancement, IEEE Trans. Speech an Audio Processing, vol. 13, No. 3, pp. 309-320, May 2005.
J. Allen and D. Berkley, Image Method for Efficiently Simulating Small-Room Acoustics, J. Acoust. Soc. Am., pp. 943-950, 1979.
J. Garas, Adaptive 3D Sound Systems, Kluwer Academic Publishers, 2000.
Herbert Buchner, Robert Aichner and Walter Kellermann, Relation between Blind System Identification and Convolutive Blind Source Separation, Hands-free Speech Communication and Microphone Arrays Workshop, Piscataway, NJ, USA, 2005.
Herbert Buchner, Robert Aichner, Jochen Stenglein, Heinz Teutsch and Walter Kellermann, Simultaneous Localization of Multiple Sound Sources using Blind Adaptive MIMO Filtering, Proc. IEEE Int. Conf. on Acoustics, Speech, and Signal Processing (ICASSP), Philadelphia, USA, Mar. 2005.
R. Martin, Noise Power Spectral Density Estimation Based on Optimal Smoothing and Minimum Statistics, IEEE Trans. Speech and Audio Processing, vol. 9, No. 5, pp. 504-512, Jul. 2001.
S. Haykin, Adaptive Filter Theory, 4th edition, Prentice-Hall, 2002.
T. Takatani, T. Nishikawa, H. Saruwatari and K. Shikano, High-Fidelity Blind Separation of Acoustic Signals using SIMO-Model-Based ICA with Information-Geometric Learning, Proc. Int. Workshop on Acoustic Echo and Noise Control (IWAENC), Sep. 2003, Kyoto, Japan.
K. Matsuoka and S. Nakshima, Minimal Distortion Principle for Blind Source Separation, Proc. Int. Conf. on Independent Component Analysis and Blind Signal Separation, Dec. 2001, San Diego, CA, USA.
T. J. Klasen, M. Moonen, T. Van Den Bogaert and J. Wouters, "Preservation of interaural time delay for binaural hearing aids through multi-channel Wiener filtering based noise reduction", Proc. IEEE Int. Conf. on Acoustics, Speech, and Signal Processing (ICASSP), Philadelphia, USA, Mar. 2005.
W. Herbordt, F. Nakamura, W. Kellermann "Multi-channel estimation of power spectral density of noise for mixtures of non-stationary signals", IPSJ SIG Technical Reports, vol. 2004, No. 131, pp. 211-216, Kyoto, Japan, Dec. 2004.
W. Herbordt. T. Trini, W. Kellermann "Robust spatial estimation of the signal-to-interference ratio for non-stationary mixtures", Proc. Int. Workshop on Acoustic Echo and Noise Control, pp. 247-250, Kyoto, Japan, Sep. 2003.
Herbert Buchner, Robert Aichner, Walter Kellermann "Trinicon: A Versatile Framework for Multichannel Blind Signal Processing", Proc. IEEE Int. Conf. on Acoustics, Speech and Signal Processing (ICASSP), pp. 889-892, vol. 3, Montreal, Canada, May 2004.
S. Ikeda, N. Murata, "A method of ICA in time-frequency domain", in Proc. Int. Symposium on Independent Component Analysis and Blind Signal Separation, pp. 365-371, Aussois, France, Jan. 1999.
Siow Yong Low et al, "A hybrid speech enhancement system employing blind source separation and adaptive noise cancellation"; Signal Processing Symposium, 2004. NORSIG 2004; Proceedings of the 6th NORDIC ESP00, Finland; Jun. 9-11, 2004; Piscataway, NJ, pp. 204-207; ISBN 951-22-7065-X.
Nguyen Thi H L et al; "Speech Enhancement: Analysis and Comparison of Methods on Various Real Situations"; Signal Processing Theories and Applications. Brussels, Aug. 24-27, 1992; Proceedings of the European Signal ProCessing Conference (EUSIPCO0, Amsterdam, Elsevier, NL. vol. 1 Conf 6, Aug. 24, 1992, pp. 303-306, XP000348664, ISBN: 0-444-89587-6.

* cited by examiner

SIGNAL SEPARATOR, METHOD FOR DETERMINING OUTPUT SIGNALS ON THE BASIS OF MICROPHONE SIGNALS, AND COMPUTER PROGRAM

CROSS REFERENCE TO RELATED APPLICATIONS

This application is the US National Stage of International Application No. PCT/EP2007/005182, filed Jun. 16, 2007 and claims the benefit thereof. The International Application claims the benefits of German application No. 10 2006 027 673.6 DE filed Jun. 14, 2006, both of the applications are incorporated by reference herein in their entirety.

FIELD OF INVENTION

The present invention generally relates to a signal separator for determining a first output signal describing an audio content of a useful-signal source within a microphone signal, and for determining a second output signal describing an audio content of the useful-signal source within a second microphone signal, to appropriate methods, and to an appropriate computer program. Specifically, the present invention relates to a technique and a method of restoring spatial information in blind source separation systems.

BACKGROUND OF INVENTION

In many technical applications it is necessary to process an input signal such that in an output signal, audio contents of a useful-signal portion are contained in an essentially unchanged manner relative to the input signal, whereas, on the other hand, audio contents of an interference-signal portion are reduced in the output signal.

Techniques for blind source separation (also referred to as BSS below) have been developed to separate several signals, which are assumed to be statistically independent, from point sources (e.g. voice signals within a room). Respective techniques are described, for example, in publications [1], [2], [3] and [4] (cf. bibliography).

By means of several sensors (e.g. microphones), convolutive mixtures of the point sources (or signals sources) are recorded and demixed using downstream multichannel adaptive filtering. This demixing is based on that the output signals of the multichannel adaptive filtering are to be mutually statistically decoupled again up to statistical moments of a certain order. It is thus the object of blind source separation that ideally, only one of the source signals (i.e. one signal from a point source, or signal source) be applied in each output channel, respectively. However, the disadvantage thereof is that due to the respective one-channel representation at the output after the demixing, the spatial information about the point sources (or signal sources) is lost (in particular level differences and run-time differences between the sensors).

Generally, the object envisaged is to restore spatial information about a spatial location of a point source, or signal source (at the output of a source separation). Several works have already been performed and published in the field mentioned, as will be described below.

SUMMARY OF INVENTION

The known approaches, however, still have several limitations, as will also be set forth below. This is expressed, above all, when using BSS methods in realistic application scenarios wherein in addition to a desired point source (or signal source), residual portions of the other sources, respectively (i.e., for example, of further point sources, or signal sources, or interference sources) may still be present at the outputs of the blind signal separation (i.e. at the BSS outputs).

In some current systems in accordance with the prior art, spatial information is either dispensed with (cf., e.g., [1], [2], [3], [4]), or spatial information is restored by means of downstream processing.

On this issue, four methods are known from the literature:

1. The spatial information is generated by means of downstream filtering of the BSS output signals with artificial spatial characteristics or spatial characteristics which are pre-determined independently of the BSS (or transfer functions) (cf. [6], [7], [8]). For example, WO2004/006624 A1 (also referred to as [8]) shows how to select transfer functions, or spatial pulse responses, from a database of head-related transfer functions (HRTFs).
2. In specific BSS methods it is possible to perform blind system identification (cf. [9], [10]) such that the spatial information may be derived from demixing filters of the BSS system. The spatial information may be generated, in turn, by means of downstream filtering of the BSS output signals using the identified spatial characteristic.
3. In addition, with methods which perform no blind system identification, it is possible to derive spatial information from the demixing filters of the BSS system. In [19] a technique was shown wherein this information is used on the part of a downstream filtering, and which thus generates output signals comprising a spatial characteristic.
4. In a further concept, the original sensor signals are processed within a post-processing block along with the output signals of a multichannel noise reduction (cf. [5]).

Just like blind source separation (BSS), multichannel noise reduction is also a method of improving specific desired signals (point sources, or signal sources) which is based, however, on a steady-state assumption of the respective interference source, in contrast to BSS (cf., e.g., [11]).

As is shown in [5], for example, the approach mentioned includes connecting the output channels of the multichannel noise reduction system $y_P(n)$ to respective one-channel adaptive filters which include the delayed microphone signals as reference signals $d_P(n)$ (cf. FIG. 1 in [5]). Adaptive time-discrete filters represent a widely used technique in digital signal processing (cf. [12]). The known principle consists in determining filter coefficients such that the output signal of the system is approximated, given a known input signal, to a reference signal (compare [12]). In the concept in accordance with [5], this is achieved by minimizing an error signal $e_P(n)=d_P(n)-y_P(n)$ in accordance with a specific criterion (e.g. in accordance with a mean square error).

Using the above-described four methods, a spatial position of a desired point source (or signal source) is reproduced correctly. However, all of the four methods described have the disadvantage that in addition to the desired point source, the residual portions of the respective other sources (i.e. of the further signal sources or interference sources) which may still be present are also mapped to the same spatial position.

A further method which takes into account both the spatial information of the point source desired and is to avoid the problem of mapping to the same location was proposed in [13]. The approach in accordance with [13] is based on a joint optimization of two or more coupled BSS criteria. This leads to two or more adaption equations which are coupled to one another in a non-linear manner, it being impossible to ensure that a global optimum may be found. One implementation of the method in accordance with [13] has also shown that thereby, the point source desired and the residual portions of the suppressed sources (or of the further signal sources or interference sources) which are still present are also mapped onto the same location.

In addition, [15] shows a method of maintaining a time delay between two channels for two-ear hearing aids by using noise reduction based on Wiener filtering. In accordance with [15], several microphone signals are fed to two separate multichannel Wiener filters. An output signal of a first Wiener filter, which represents an estimated value of a noise, is subtracted from the first microphone signal. An output signal of a second Wiener filter, which represents a further estimated value of a noise, is subtracted from a second microphone signal. Thus, output signals are obtained by means of the subtractions.

Considering the prior art described, it is the object of the present invention to provide a concept for signal separation in accordance with which a plurality of output signals are formed, on the basis of a plurality of input signals, such that the output signals reproduce a spatial position of a useful-signal source with a sufficient level of accuracy, that interference signals from interference-signal sources are reduced in the output signals, and that residual interference signals from the interference-signal sources are not mapped to the location of the useful-signal source.

This object is achieved by a signal separator, by a method, and by a computer program.

The present invention provides a signal separator for determining a first output signal describing an audio content of a useful-signal source in a first microphone signal and for determining a second output signal describing an audio content of the useful-signal source in a second microphone signal.

It is the core idea of the present invention that it is advantageous to configure a source separator such that a first partial signal provided by the source separator essentially represents (or describes) an audio content of a first signal source (useful-signal source), it also being ensured that the first partial signal exhibits as little distortion as possible relative to a first input signal of the source separator (e.g. relative to the first microphone signal). Due to the above-mentioned implementation of the source separator, the first partial signal thus essentially corresponds to the signal portion, provided by the first signal source (useful-signal source) in the first input signal of the source separator (i.e., e.g., in the first microphone signal). Also, one has found that it is advantageous to implement the source separator in such a manner that a second partial signal provided by the source separator essentially represents an audio content of the second signal source (interference-signal source), and that also the second partial signal exhibits as little distortion as possible relative to the second input signal of the source separator (e.g. relative to the second microphone signal). Thus, the second partial signal essentially corresponds to a contribution of the second signal source (interference-signal source) to the second input signal of the signal separator (e.g. the second microphone signal).

Thus, two partial signals are available at the outputs of the source separator, the first partial signal essentially including the audio content of the first signal source (useful-signal source) and being distorted, relative to the first microphone signal, by a maximum distortion at the most (or to as small an extent as possible), and, further, the second partial signal essentially including an audio signal content of the second signal source (interference-signal source) and being distorted, relative to the second microphone signal, by a maximum distortion at the most (or to as little an extent as possible).

Consequently, the first partial signal is directly usable as a first output signal. The second partial signal may also be used directly to remove the audio content of the second partial signal from the second microphone signal, the second output signal being caused due to the removal of the second partial signal from the second microphone signal.

In the inventive manner, one achieves that the first partial signal exhibits as little distortion as possible relative to the first microphone signal. Consequently, phase information of the audio content of the first signal source in the first partial signal matches phase information of the audio content of the first signal source in the first microphone signal. Phase information of a residual portion of the audio content of the second signal source, which may possibly still be contained in the first partial signal, incidentally comprises a same phase information, due to the limitation of the distortion between the first microphone signal and the first partial signal, as the audio content of the second signal source in the first microphone signal. By means of the limitation of the distortion when forming the partial signal, one thus achieves that the audio content of the second signal source in the first partial signal, or in the first output signal, is mapped to a different location (typically to the location of the second signal source) than the audio content of the first signal source is mapped to.

A distortion of the audio content of the second signal source in the second partial signal relative to the second microphone signal is also limited in the same manner. Therefore, the second partial signal is highly suited to remove the audio content of the second signal source from the second microphone signal, e.g. by a simple difference formation. Specifically, since the second partial signal essentially corresponds, in an un-distorted manner, to the portion of the second signal source in the second microphone signal, the difference between the second microphone signal and the second partial signal essentially represents the audio content, stemming from the first signal source, in the second microphone signal.

Since, in addition, the second partial signal is distorted, or phase-changed, to a limited extent only, relative to the second microphone signal, the second partial signal represents the second signal source at its correct spatial position. Thus, the audio content of the second signal source is removed in a spatially correct manner by the signal remover, as a result of which the residual portion of the audio content of the second signal source in the second output signal is minimized.

In addition, a residual signal portion of the first signal source is represented, in the second partial signal, in a spatially correct manner with regard to the second input signal (e.g. the second microphone signal). In this manner, one avoids that when removing the second partial signal from the second microphone signal (e.g. by forming a difference), a portion of the audio content of the first signal source which is incorrectly localized in terms of space is introduced by the residual signal portion of the first signal source.

In addition, on account of the inventive implementation of the source separator, the signal remover may be implemented in a particularly simple manner, since the distortion between the second microphone signal and the second partial signal is limited by the source separator.

The inventive signal separator thus offers the essential advantage that due to the limitation of the signal distortion in the source separator, the output signals of the source separator describe—in a direct manner and without any further post-processing—a spatial location of the first signal source and of the second signal source. While the first partial signal directly describes that portion in the first microphone signal which stems from the signal source, the portion of the first signal source in the second microphone signal is obtained by simply removing the second partial signal from the second microphone signal. Thus, the first and second output signals correctly describe a spatial location of the first signal source as is perceivable at the positions of the acoustic sensors, interferences being largely suppressed by the second signal source in the output signals.

Also, the source separator used may be a conventional source separator which provides at its outputs one-channel representations of the audio contents of the various signal sources, the conventional source separator only needing to be implemented for a limitation or minimization of a distortion between its first input (for the first microphone signal) and its first output (for the first partial signal) as well as for a limitation or minimization of a distortion between its second input (for the second microphone signal) and its second output (for the second partial signal).

In addition, the inventive signal separator offers the advantage that residual portions of the interference-signal sources are not changed with regard to their spatial locations relative to the input signals, or microphone signals, i.e. that residual signals from the interference-signal sources are mapped to the original or actual positions of the interference-signal sources.

In a preferred embodiment, the source separator is implemented to separate the audio contents of the at least two signal sources (i.e. of the useful-signal source and the interference-signal source) on account of their spatial locations within the room or on account of their statistical properties. Separating the signal sources on account of their correlation properties is particularly advantageous, since in this case, signal separation is performed in a blind manner, or without any prior knowledge of the spatial locations of the signal sources, or of any sound propagation in the room. Thus, the source separator requires only a minimum amount of prior information, i.e. information about the correlation properties, or the signal statistics, of the signals generated by the signal sources.

In a further embodiment, the source separator is adapted to determine the parameters of the processing specification for generating the first partial signal as a function of a measure of the distortion of the first partial signal relative to the first microphone signal, and to set an upper limit to the distortion of the first partial signal relative to the first microphone signal. In other words, the parameters of the processing specification for determining the first partial signal and the second partial signal are determined such that the distortion has an upper limit. This may be performed, for example, by predefining a predefined space of values for the parameters of the processing specification, the space of values being selected such that the distortion is smaller than a maximum distortion. For example, the predefinition may state that the first partial signal differs from the first microphone signal, in accordance with a predetermined norm (for example in a mean square), by less than a predefined maximum deviation.

In one embodiment, the source separator is implemented to change the parameters of the processing specification in such a manner that a distortion between the first microphone signal and the first partial signal will be reduced if it is established that the distortion is larger than a predefined threshold value. Alternatively or additionally, the source separator may further be implemented to take into account a measure of the distortion of the first partial signal relative to the first microphone signal (or of the second partial signal relative to the second microphone signal) when setting or optimizing the parameters of the processing specification (cf., e.g., [14]).

By means of the above-mentioned measure, one achieves that all in all, the distortion between the first microphone signal and first partial signal (or between the second microphone signal and the second partial signal) is provided with an upper limit or is minimized).

In a further preferred embodiment, the source separator is implemented to determine the parameters of the processing specification (or processing specifications) for generating the first partial signal and the second partial signal by means of an optimization using a cost function. By means of the above-mentioned optimization, a best result possible may be achieved which comprises a balance between the separation of the signal sources (statistical independence between the partial signals) and the distortion.

In accordance with a further alternative embodiment, the present invention includes a signal separator.

The signal separator as claimed in an independent claim is based on the core idea that it is advantageous to extract, with a source separator, an interference signal from an interference-signal source from at least two microphone signals, to distort the resulting partial signal at least twice in different ways with an adjustable filter, to remove the first distorted partial signal from the first microphone signal, and to remove the second distorted partial signal from the second microphone signal. This results in a first corrected microphone signal forming the first output signal, and in a second corrected microphone signal forming the second output signal. A parameter adjuster is further implemented to adjust the filter parameters in the generation of the first distorted partial signal and the filter parameters in the generation of the second distorted signal in a mutually independent manner, so that versions of the interference signal of the interference-signal source which are distorted in various manners are removed from the first microphone signal and from the second microphone signal. The parameter adjuster is thus implemented to adjust the parameters for generating the first and second distorted partial signals in a mutually independent manner, so that an independent minimization, or reduction, of the audio content of the interference-signal source is conducted in both microphone signals. This is advantageous, since the contribution of the interference-signal source in the first microphone signal differs from the contribution of the interference-signal source in the second microphone signal, since, as is known, there are different propagation paths between the interference-signal source and the acoustic sensors for generating the microphone signals.

In addition, the adaptive distortion of the partial signal, which is preferably performed such that, e.g., in the first corrected microphone signal an audio content of the interference-signal source is reduced at the output of the signal remover, ensures that in the first distorted partial signal, the interference-signal source is mapped to the same spatial position as is described by the first microphone signal. The combination of the first distorted partial signal and the first microphone signal thus results in that a residual portion of the audio content of the interference-signal source is mapped to the actual spatial position of the interference-signal source.

By analogy therewith, the residual portion of the interference-signal source is mapped, in the second output signal, to the actual position of the interference-signal source on the basis of the approach mentioned. Thus, the position of the interference-signal source in both output signals is represented correctly, as far as there are residual portions of the interference-signal source present in the output signals.

In addition, it shall be noted that the two output signals are essentially based directly on the two input signals, or microphone signals, only signal portions of the interference-signal sources being removed from the input signals, or microphone signals. Therefore, the two output signals also correctly reproduce the spatial position of the useful-signal source.

A further advantage of the inventive signal separator is that the source separator only needs to be able to extract the signal of the interference-signal source from the two microphone signals. Therefore, the source separator only needs to provide a one-channel output signal which reproduces the audio content of the interference-signal source. A distortion of the partial signal relative to the microphone signal which may occur in the source separator is balanced by the adjustable filter, the adjustable filter distorting the partial signal in two manners which may be adjusted independently of each other, so as to do justice to the fact that versions of the interference signal of the interference source which are distorted in various manners need to be removed from both microphone signals.

In a further preferred embodiment, the parameter adjuster is implemented to determine the power in the first corrected microphone signal and the power in the second corrected microphone signal, so as to change the filter parameters of the first adjustable filter such that a power in the first corrected microphone signal is reduced, and to change the filter parameters of the second adjustable filter such that the power in the second corrected microphone signal is reduced. It has actually turned out that the power in the first corrected microphone signal and the power in the second corrected microphone signal are readily usable criteria of whether the distortion of the partial signal is correctly adjusted by the adjustable filter in the generation of the first and second distorted partial signals. Since essentially only one signal portion from the interference-signal source is contained in the first and second distorted partial signals, a power of the first corrected microphone signal will become minimal, for example, if the adjustable filter is adjusted such that the audio content of the interference-signal source is minimized in the first corrected microphone signal. The above-mentioned fact may also be exploited, in a particularly efficient manner, in time intervals during which the signal of the useful-signal source is very weak, since then the signal from the interference-signal source will dominate in the microphone signals. An analogous statement also applies to the optimum adjustment of the filter parameters for generating the second distorted partial signal.

It shall be pointed out here that the signal contemplated is also, for example, a block, or a temporal portion, which may have, for example, energy or a (mean) power associated with it.

In a further preferred embodiment, the parameter adjuster comprises a useful-signal recognizer implemented to recognize when a useful signal from a useful-signal source comprising at least a minimum useful-signal strength is present in the first and/or second microphone signals. The parameter adjuster is further implemented to change the filter parameters only in case no useful signal comprising at least the minimum useful-signal strength is present. Specifically, it has been found that an adjustment of the filter parameters may then be performed in an optimum manner by minimizing the power of the microphone signals corrected. Specifically, if there is no or only a very small useful signal, the power of the microphone signals corrected will become zero or at least very small if the filter parameters of the adjustable filter are adjusted such that there is an optimum reduction of the audio content of the interference-signal source in the microphone signals corrected.

BRIEF DESCRIPTION OF THE DRAWINGS

Preferred embodiments of the present invention will be explained below in more detail with reference to the accompanying figures, wherein.

DETAILED DESCRIPTION OF INVENTION

Figure 1:
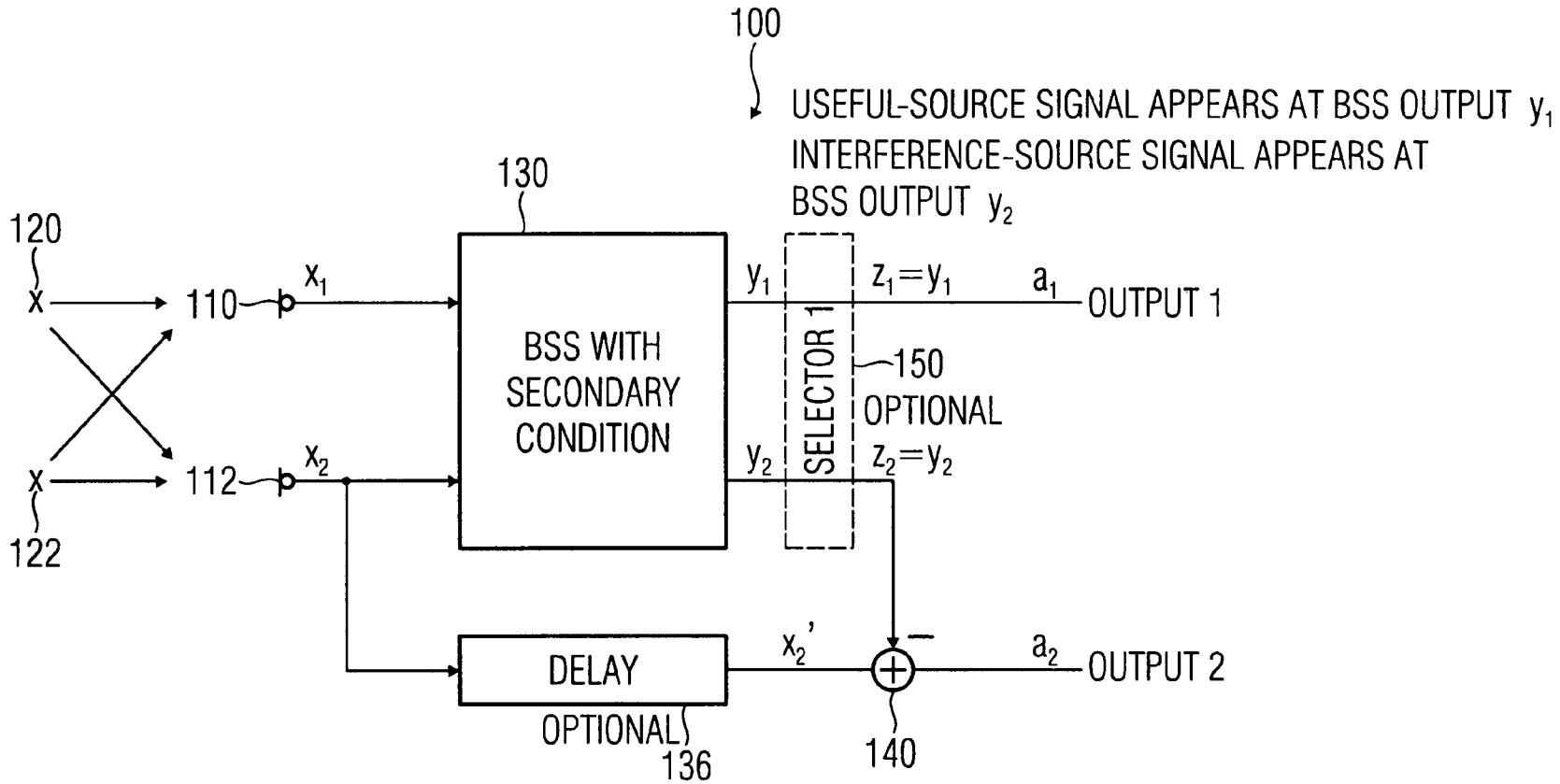
FIG. 1 is a block diagram of an inventive signal separator using a source separator with a secondary condition, in accordance with a first embodiment of the present invention.

FIG. 1 shows a block diagram of an inventive signal separator using a source separator with a secondary condition, in accordance with a first embodiment of the present invention. The arrangement in accordance with FIG. 1 is designated by 100 in its entirety. Signal separator 100 receives two microphone signals $x_1$, $x_2$ from two microphones, or acoustic sensors, 110, 112. The microphones, or acoustic sensors, 110, 112 record acoustic signals from at least two signal sources 120, 122, a first signal source 120 being referred to as useful-signal source below, and a second signal source 122 being referred to as an interference-signal source below. Typically, useful-signal source 120 is perceivable both by the first acoustic sensor 110 and by the second acoustic sensor 112. Also, the interference-signal source typically is perceivable both by first acoustic sensor 110 and by second acoustic sensor 112. Thus, the first microphone signal $x_1$ typically comprises signal portions both from useful-signal source 120 and from interference-signal source 122. Likewise, second microphone signal $x_2$ typically also comprises signal portions both from useful-signal source 120 and from interference-signal source 122.

It is to be noted here that microphone signals $x_1$ and $x_2$ need not be directly generated by microphones, or acoustic sensors, 110, 112, but that microphone signals $x_1$ and $x_2$ may also be formed, e.g., by a transmission of audio signals (e.g. via an analog or digital data link). In addition, microphone signals $x_1$, $x_2$ may also stem from an audio reproducing equipment or from a computer.

A blind source separator 130 receives the two microphone signals $x_1$, $x_2$ and generates two partial signals $y_1$, $y_2$ on the basis of microphone signals $x_1$, $x_2$. In this context, first partial signal $y_1$ essentially comprises an audio content of useful-signal source 120, whereas second partial signal $y_2$ essentially comprises an audio content of interference-signal source 122. First partial signal $y_1$ forms a first output signal $a_1$. An optional delay means 136 delays second microphone signal $x_2$ and therefore provides a delayed microphone signal $x_2'$. A difference former 140 receives the delayed second microphone signal $x_2'$ and is implemented to subtract second partial signal $y_2$ from the delayed second microphone signal $x_2'$. Difference former 140 thus forms a second output signal $a_2$ as a difference between delayed second microphone signal $x_2'$ and second partial signal $y_2$.

In the event that delay means 136 is dispensed with, delayed second microphone signal $x_2'$ is identical to second microphone signal $x_2$.

On the basis of the structural description of the inventive signal separator 100, its function will be explained below.

Blind source separator 130 is implemented to perform a blind source separation while using a secondary condition. The blind source separator provides the first partial signal $y_1$, which essentially includes the audio content of the first signal source, or useful-signal source, 120 and wherein an audio content of the second signal source, or interference-signal source, 122 is at least 3 dB, preferably, however, 6 dB (even better, however, at least 10 dB, or at least 20 dB) weaker than the audio content of first signal source, or useful-signal source, 120. In addition blind source separator 130 is implemented to generate second partial signal $y_2$ in such a manner that the second partial signal essentially includes the audio content of the second signal source, or interference-signal source, 122, i.e. that, for example, the audio content of first signal source 120 in second partial signal $y_2$ is at least 3 dB, preferably, however, at least 6 dB (even better, however, at least 10 dB, or at least 20 dB) weaker than the audio content of the interference-signal source. Thus, blind source separator 130 provides, as the two partial signals $y_1$, $y_2$, two signals containing the audio contents of first signal source 120 and of second signal source 122 as one-channel signals which are essentially separate from each other.

Blind source separator 130 is further implemented to ensure that a distortion between first partial signal $y_1$ and first microphone signal $x_1$ is smaller than a maximum distortion, the maximum distortion typically being predefined. The maximum distortion may be defined, for example, by a mean square deviation between first partial signal $y_1$ and first microphone signal $x_1$. The measure of the deviation between first partial signal $y_1$ and first microphone signal $x_1$ may also be related, for example, to a power in first microphone signal $x_1$ and/or to a power in first partial signal $y_1$.

Optionally, blind source separator 130 may further be implemented to ensure that distortion between second partial signal $y_2$ and second microphone signal $x_2$ is smaller than a maximum distortion, the maximum distortion typically being predefined. The maximum distortion of second partial signal $y_2$ relative to second microphone signal $x_2$ may be, e.g., identical to the maximum distortion of first partial signal $y_1$ relative to the first microphone signal, or it may differ therefrom. In a preferred embodiment, blind source separator 130 is implemented to provide an upper limit both to the distortion of first partial signal $y_1$ relative to first microphone signal $x_1$, and to the distortion of second partial signal $y_2$ relative to second microphone signal $x_2$.

Blind source separator 130 may further be implemented to minimize a distortion of first partial signal $y_1$ relative to first microphone signal $x_1$ (and, optionally, additionally a distortion of second partial signal $y_2$ relative to second microphone signal $x_2$), or to take into account at least one criterion describing the magnitude of the distortion when adjusting the parameters. Details with regard to an implementation of a blind source separator comprising a secondary condition and enabling an optimization or minimization of a distortion are described, for example, in the publication [14] by K. Matsuoka and S. Nakashima.

Thus, blind source separator 130 comprising the above-mentioned secondary condition, which leads to a limitation (or optimization or minimization) of the distortion, ensures that first partial signal $y_1$ essentially comprises the audio content of first signal source 120 and further is not too highly distorted relative to first microphone signal $x_1$.

Thus, blind source separator 130 is implemented such that first partial signal $y_1$ essentially includes that portion of first microphone signal $x_1$ which stems from first signal source 120. On the other hand, signal portions of second signal source 122 are reduced or suppressed in first partial signal $y_1$. Thus, output signal $a_1$, which essentially is identical to first partial signal $y_1$, represents that portion of the first signal source which is contained in microphone signal $x_1$, and is further only slightly distorted relative to first microphone signal $x_1$ (within the framework specified by the secondary condition of blind signal separator 130). In other words, a phase shift between first output signal $a_1$ and first microphone signal $x_1$ is essentially independent of the adjustment of blind source separator 130. In other words, a phase shift between first output signal $a_1$ and first microphone signal $x_1$ is essentially predetermined, and/or a phase shift between first output signal $a_1$ and first microphone signal $x_1$ preferably does not fluctuate by more than +/−20° (however, better still, by not more than +/−10°, or +/−5°) when the adjustment of blind source separator 130 is changed. Similarly, blind source separator 130 comprising a secondary condition is implemented such that a phase shift between second partial signal $y_2$ and second microphone signal $x_2$ varies by less than +/−20° (however, better still, by not more than +/−10°, or +/−5°) when the adjustment of blind source separator 130 is changed.

The respective implementation of blind source separator 130 (based on the secondary condition) ensures that in first output signal $a_1$, which is based on first partial signal $y_1$, or is identical to first partial signal $y_1$, first signal source 120 is represented in a correct manner in terms of position. Also, it is ensured that in second partial signal $y_2$, the audio content of second signal source 122 is contained in an essentially undistorted manner relative to second microphone signal $x_2$, so that the audio content of second signal source 122 may be removed, by difference former 140, from second microphone signal $x_2$, or from delayed second microphone signal $x_2'$. Since second output signal $a_2$ is essentially based on second microphone signal $x_2$ and is changed, relative to the second microphone signal, only by a delay and a removal of second partial signal $y_2$, the spatial location of first signal source 120 in second output signal $a_2$ is represented correctly. In addition, by means of arrangement 100, one achieves that in output signals $a_1$, $a_2$ the spatial location of second signal source 122, or of the residual portion caused by second signal source 122, is also represented correctly.

It shall also be pointed out that arrangement 100 comprises an optional selector 150. However, in the embodiment shown, selector 150 only has the task of feeding first partial signal $y_1$ to the first output as the first output signal $a_1$, and to feed second partial signal $y_2$ to difference former 140. However, a different switching state of selector 150 is shown in FIG. 2.

Figure 2:
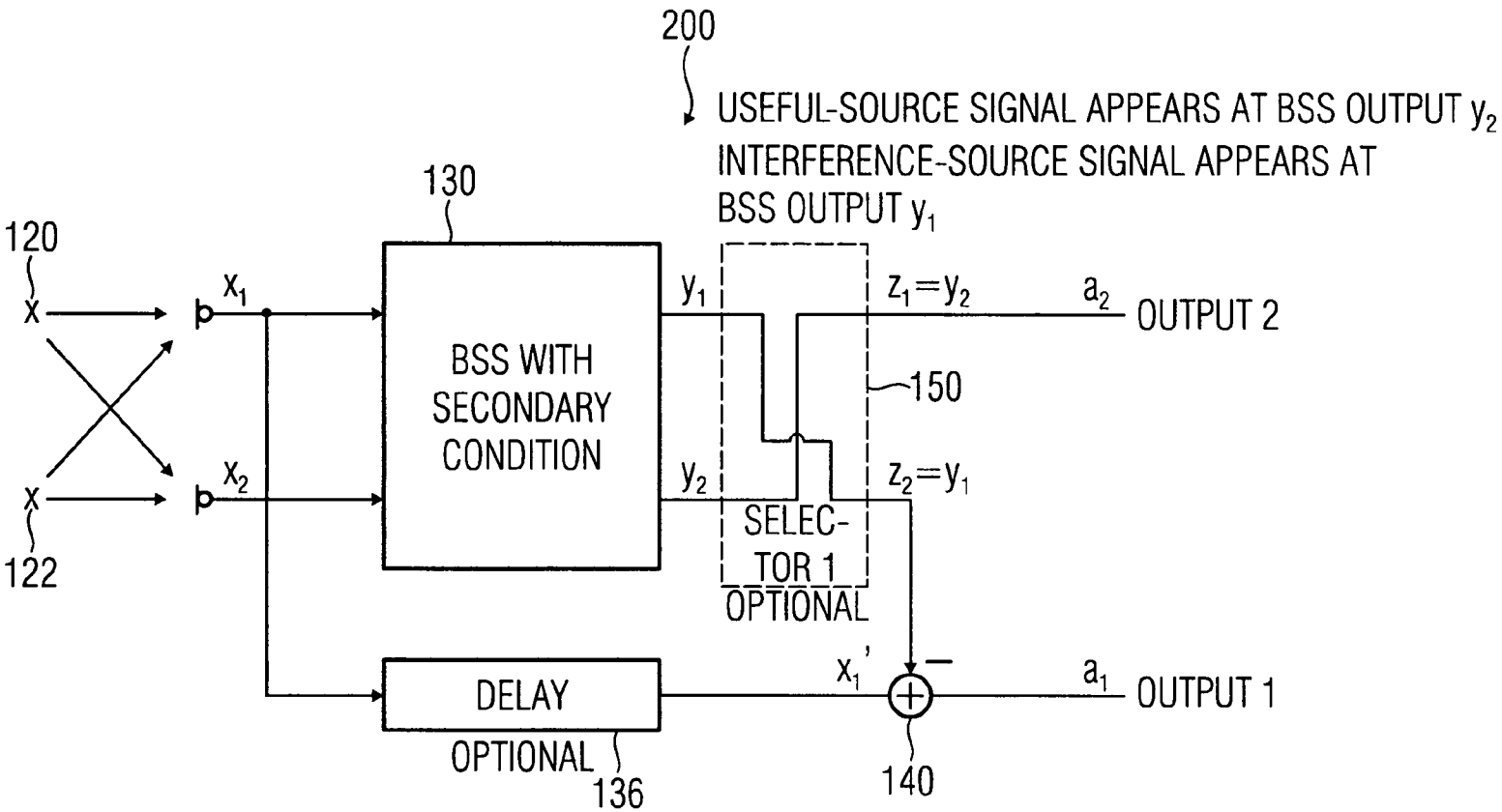
FIG. 2 is a block diagram of an inventive signal separator using a source separator with a secondary condition, in accordance with a second embodiment of the present invention.

FIG. 2 shows a block diagram of an inventive signal separator in accordance with a second embodiment of the present invention. The signal separator in accordance with FIG. 2 is designated by 200 in its entirety. Since signal separator 200 in accordance with FIG. 2 is very similar to signal separator 100 in accordance with FIG. 1, identical features and/or signals in FIGS. 1 and 2 are designated in an identical manner and will not be explained again at this point.

Arrangement 200 in accordance with FIG. 2 differs from arrangement 100 in accordance with FIG. 1 essentially in that with regard to arrangement 200, it is assumed that second signal source 122 provides the useful signal, whereas first signal source 120 provides the interference signal. In addition, it is assumed that second partial signal $y_2$ essentially comprises the audio content of second signal source 122, whereas first partial signal $y_1$ essentially comprises the audio content of first signal source 120. For this reason, second partial signal $y_2$ represents an output signal describing the signal portion, provided by second signal source 122, in second microphone signal $x_2$. For this reason, selector 150 in arrangement 200 is configured to provide second partial signal $y_2$ as second output signal $a_2$ at the second signal output. Difference former 140, however, receives first partial signal $y_1$, which essentially comprises the interference signal from interference-signal source 120. Also, difference former 140 receives first microphone signal $x_1$, or first microphone signal $x_1'$ which is delayed by optional delay means 136. Thus, the output signal of difference former 140 forms first output signal $a_1$ and is forwarded to the first output (e.g. via a further selector).

In summary, it may be established that within the framework of a blind source separation, the output of a source separator at which the useful signal is present, and the output of the source separator at which the interference signal is present, are not specified in advance. Therefore, a selection is made, preferably by a selector, as to which of the outputs of the source separator carries the useful signal and is thus directly coupled to an output of the signal separator, and as to which of the outputs of the source separator carries the interference signal and is thus coupled to an interference-signal removal means.

The selection made by the selector is performed, for example (but not necessarily), on the basis of spatial information on the positions of the sources, as is described, e.g., in [10].

In a first embodiment in accordance with FIG. 1, a first output signal $y_1$ of the source separator (or source-separator core) carries the useful signal, whereas a second output signal $y_2$ of the source separator (or source-separator core) carries the interference signal. Thus, in this case, first output signal $y_1$ forms first partial signal $z_1$, whereas second output signal $y_2$ forms second partial signal $z_2$.

In a second embodiment in accordance with FIG. 1, a first output signal $y_1$ of the source separator (or source-separator core) carries the interference signal, whereas a second output signal $y_2$ of the source separator (or source-separator core) carries the useful signal. Thus, in this case, first output signal $y_1$ forms second partial signal $z_2$, whereas second output signal $y_2$ forms first partial signal $z_1$.

Thus, it may generally be established that the distortion of the second partial signal (or of the interference signal) relative to microphone signal from which the interference signal is removed is preferably limited (e.g. by the secondary condition). However, the distortion of the first partial signal (or of the useful signal) relative to the microphone signal which is replaced by the first partial signal is preferably limited.

Figure 3:
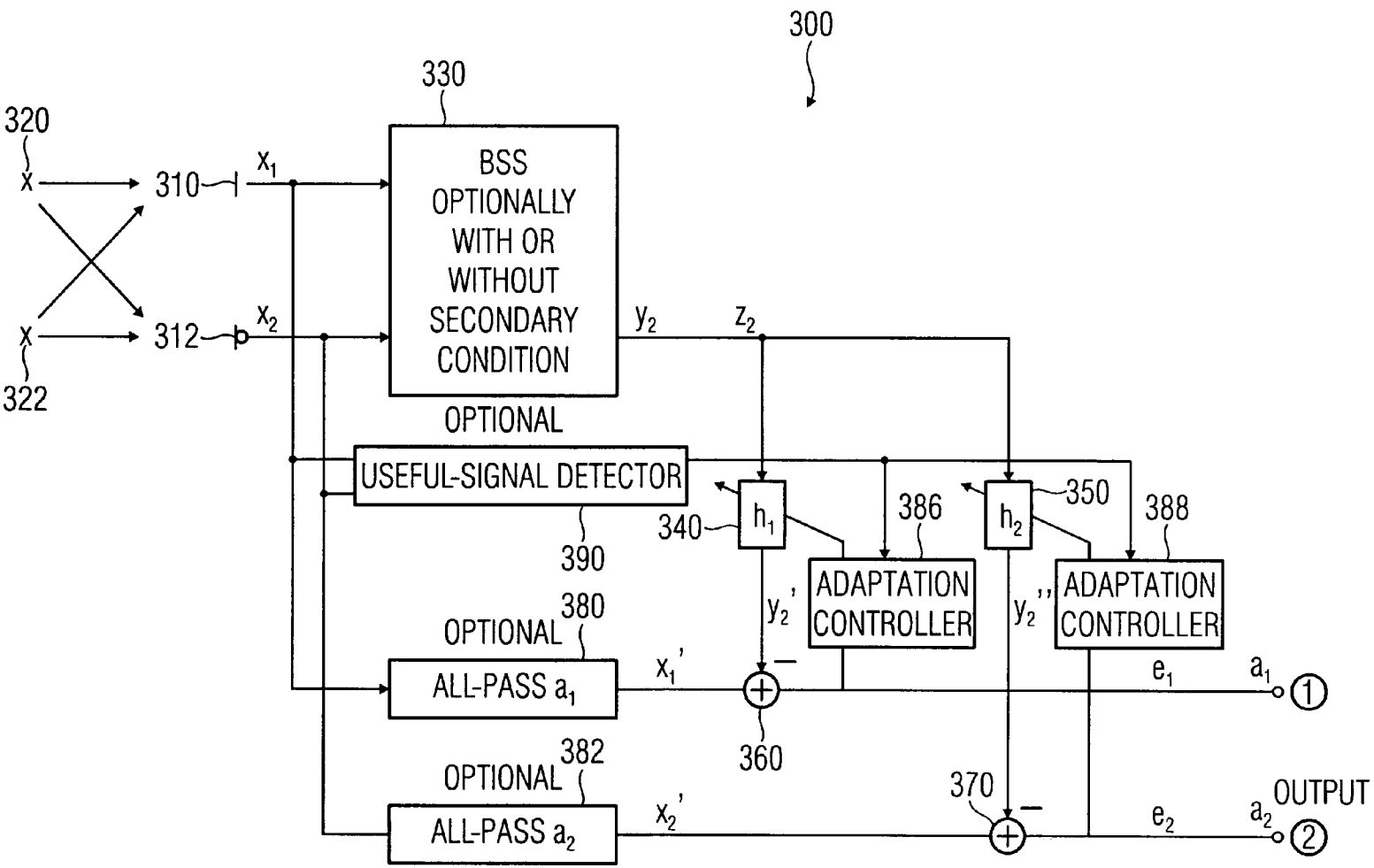
FIG. 3 is a block diagram of an inventive signal separator using an adjustable filter which filters the partial signal provided by the source separator, in accordance with a third embodiment of the present invention.

FIG. 3 shows a block diagram of an inventive source separator using an adjustable filter, in accordance with a third embodiment of the present invention. The arrangement in accordance with FIG. 3 is designated by 300 in its entirety. Arrangement 300 comprises two microphones, or acoustic sensors, 310, 312, first acoustic sensor 310 providing a first microphone signal $x_1$, and second acoustic sensor 312 providing a second microphone signal $x_2$. As was already illustrated above, however, the microphone signals may also stem from other sources, for example from a signal transmission means, an audio signal reproduction means, or a computer.

FIG. 3 further shows a first signal source 320 as well as a second signal source 322, which both emit acoustic signals which are reflected in microphone signals $x_1$, $x_2$. With regard to FIG. 3, it shall be assumed, in the following, that signal source 320 forms a useful-signal source, and that second signal source 322 forms an interference-signal source. Arrangement 300 further includes a blind source separator (BSS) 330. Blind source separator 330 receives first microphone signal $x_1$ and second microphone signal $x_2$ and is further implemented to extract a partial signal $y_2$ from the first and second microphone signals $x_1$, $x_2$. Arrangement 300 further comprises two adjustable filters 340, 350, which both receive partial signal $y_2$ as the input signal to be filtered. First adjustable filter 340 generates a first distorted partial signal $y_2'$ on the basis of partial signal $y_2$. Second adjustable filter 350 generates a second distorted partial signal $y_2''$ on the basis of partial signal $y_2$. Arrangement 300 further comprises a first difference former 360 as well as a second difference former 370. First difference former 360 receives first microphone signal $x_1$ or a signal $x_1'$ based on first microphone signal $x_1$. The signal based on first microphone signal $x_1'$ emerges from the first microphone signal, for example by an optional all-pass filtering in a filter 380. Alternatively, signal $x_1'$ may also be identical to first microphone signal $x_1$, however. Difference former 360 thus subtracts the first distorted partial signal $y_2'$ from signal $x_1'$ so as to obtain a first output signal $e_1$ (also referred to as $a_1$). In addition, second difference former 370 receives a signal $x_2'$ based on second microphone signal $x_2$, signal $x_2'$ being derived, for example, from second microphone signal $x_2$ by an (optional) all-pass filtering in a filter 382. Signal $x_2'$ may also be identical to second microphone signal $x_2$, however.

Second difference former 370 subtracts the second distorted partial signal $y_2''$ from signal $x_2'$ (or from second microphone signal $x_2$) so as to obtain, as the result, a second output signal $e_2$ (also referred to as $a_2$).

A parameter adjuster 386 (also referred to as adaption controller) associated with the first adjustable filter 340 receives first output signal $e_1$ and is implemented to adjust the parameters of the occurring filtering as a function of first output signal $e_1$. In other words, first output signal $e_1$ forms an error signal for the first adjustable filter 340. Similarly, a parameter adjuster 388 (also referred to as adaption controller) associated with the second adjustable filter 350 receives second output signal $e_2$ for adjusting the filter parameters. Second output signal $e_2$ thus serves as an error signal for the second adjustable filter 350. Adjustable filters 340, 350 are preferably adaptive filters, the filter parameters of which are adjusted by the associated parameter adjusters, or adaptation controllers, 386, 388 on the basis of the associated error signals.

It shall be pointed out here that first adjustable filter 340 and second adjustable filter 350 may also be realized as one single filter which generates first distorted partial signal $y_2'$ and second distorted partial signal $y_2''$ from partial signal $y_2$ in a mutually independent manner. In this case, too, first output signal $e_1$ serves to adjust the filter parameters which are used in generating first distorted partial signal $y_2'$ from partial signal $y_2$. Second output signal $e_2$ serves to adjust the filter parameters which are used in generating the second distorted partial signal $y_2''$ from partial signal $y_2$.

Thus, filters 340, 350 are adaptive filters, the filter characteristics of which are adjusted by parameter adjusters, or adaptation controllers, 386, 388 as a function of the associated output signals $e_1$, $e_2$, first output signal $e_1$ representing the difference between first microphone signal $x_1$ (or the delayed and/or all-pass filtered signal $x_1'$ which is based thereon) and first distorted partial signal $y_2'$, and second output signal $e_2$ representing the difference between second microphone signal $x_2$ (or signal $x_2'$ derived therefrom by a delay and/or all-pass filtering) and second distorted partial signal $y_2''$.

Generally, first filter 340 may thus also be regarded, in conjunction with parameter adjuster 386, as an adaptive filter implemented to adjust the filter parameters such that first distorted partial signal $y_2'$ matches (as well as possible) first microphone signal $x_1$, or signal $x_1'$ derived therefrom. In other words, first microphone signal $x_1$, or signal $x_1'$ derived therefrom, serves as a reference signal for the adjustments of the filter parameters of first adjustable filter 340. Similarly, second microphone signal $x_2$, or signal $x_2'$ derived therefrom, serves as a reference signal for adjusting the filter parameters of second adjustable filter 350 so as to preferably adjust the second filter such that the second distorted partial signal matches (as well as possible) the second microphone signal $x_2$, or signal $x_2'$ derived therefrom.

It shall be noted that the adjustment of the filter coefficients of the adjustable filters 340 or 350 is preferably performed when essentially only a portion of interference-signal source 322 is contained in microphone signals $x_1$, $x_2$, or in signals $x_1'$, $x_2'$ derived therefrom. In this case, the parameters of filters 340, 350 may be adjusted, on the basis of output signals $e_1$, $e_2$, such that first distorted partial signal $y_2'$ essentially corresponds to that portion in microphone signal $x_1$, or in signal $x_1'$, which is caused by interference-signal source 322, and such that second distorted partial signal $y_2''$ essentially corresponds to that portion of the interference-signal source 322 which is contained in second microphone signal $x_2$, or in signal $x_2'$. Within the framework of the above-mentioned conditions, a portion in first output signal $e_1$ and in second output signal $e_2$ which is caused by interference-signal source 322 is effectively reduced or possibly even minimized (for example with regard to a power or energy).

The filter parameters of first adjustable filter 340 and of second adjustable filter 350 thus are preferably adjusted, or adapted, when essentially only a portion of interference-signal source 322 is contained in microphone signals $x_1$, $x_2$, i.e. when only a negligible portion of useful-signal source 320 is contained in microphone signals $x_1$, $x_2$. To this end, arrangement 300 optionally comprises a useful-signal detector 390 which is implemented, for example, to recognize when the useful signal from useful-signal source 320 is below a predefined or variable threshold level. For this purpose, for example, useful-signal detector 390 receives first microphone signal $x_1$ and second microphone signal $x_2$ (or, alternatively, only one of the microphone signals). Useful-signal detector 390 may be, for example, a voice detector which recognizes when there is a voice signal (if, for example, only voice signals are contemplated as useful signals). Thus, useful-signal detector 390 may serve as a control means for adaptation controller 386, 388, and may (optionally) control the adaptation controllers 386, 388 associated with adjustable filters 340, 350 such that their filter parameters are changed, or adapted, only when the audio content of the useful signal in microphone signals $x_1$, $x_2$ is weaker than a predefined or variable threshold value.

Irrespective of whether a useful-signal detector 390 is employed (but preferably in conjunction with the employment of a useful-signal detector 390), the adaptation controllers 386, 388 associated with adjustable filters 340, 350 may be implemented to adjust the respective filter parameters in such a manner that, for example, a power or energy of first output signal $e_1$, or of second output signal $e_2$, is reduced by a change in the filter parameters, or that the above-mentioned power or energy is minimized by a change in the filter parameters. In other words, in adjusting the filter parameters, a change in the filter parameters may be allowed, for example, only in such a manner that the power or energy contained in first output signal $e_1$, and/or the power or energy contained in second output signal $e_2$ is reduced. The power or energy in first output signal $e_1$ or in second output signal $e_2$ may thus also be interpreted as a square error describing a deviation, for example, between signal $x_1'$ and first distorted partial signal $y_2'$, or between signal $x_2'$ and second distorted partial signal $y_2''$.

In other words, it is preferred to change the filter parameters, e.g., of first adjustable filter 340 (by means of associated adaptation controller 386) in such a manner that a deviation between signal $x_1'$ and first distorted partial signal $y_2'$ is reduced or minimized with regard to a measure of distance. The measure of distance may be, for example, any mathematical norm of the differential signal, or error signal, $e_1$. The filter parameters of second adjustable filter 350 may be adjusted (by associated adaptation controller 388) in an analogous manner.

Further details regarding an adaptation control of filters monitored may be seen, for example, from publications [16] and [17]. In a preferred implementation of the inventive concept, an adaptation controller following equation 2 of publication [17] is used. The adaptation controller used within the context of the present invention differs from the adaptation controller shown in [17] in terms of the manner in which the two power density spectra are calculated. Within the context of the present invention, a power density spectrum of the output signal of the blind source separation (BSS) is preferably estimated. In addition, a power density spectrum of a differential signal (e.g. of a signal e1, e2) between a microphone signal and an output signal of the blind source separation is preferably estimated.

Figure 4:
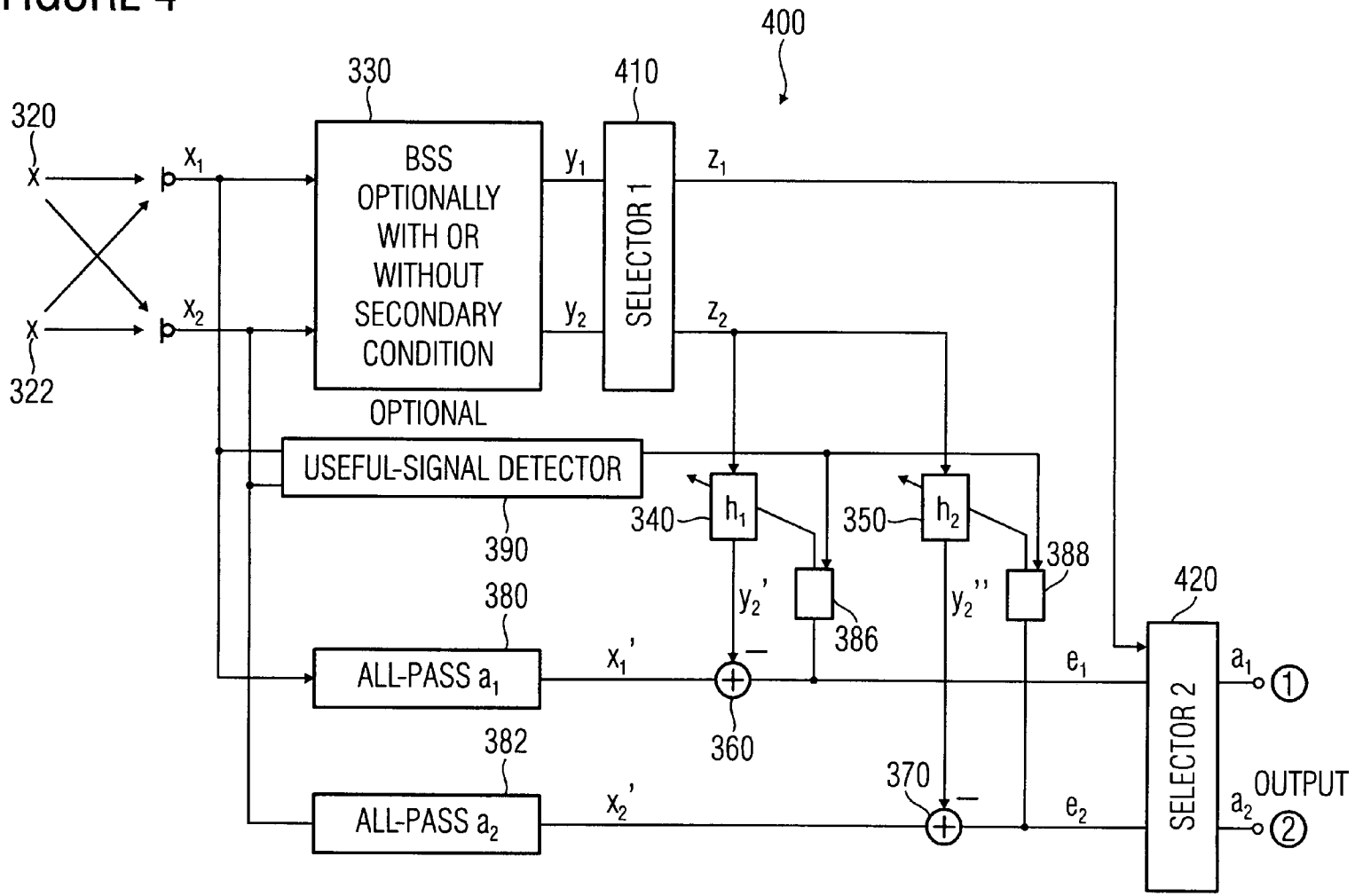
FIG. 4 is a block diagram of a reconfigured inventive signal separator, in accordance with a fourth embodiment of the present invention.

FIG. 4 shows a block diagram of an inventive signal separator in accordance with a fourth embodiment of the present invention. The signal separator in accordance with FIG. 4 is designated by 400 in its entirety. Signal separator 400 in accordance with FIG. 4 is very similar to signal separator 300 in accordance with FIG. 3, so that identical features, or signals, in FIGS. 3 and 4 are designated by the same reference numerals.

Signal separator 400 in accordance with FIG. 4 differs from signal separator 300 in accordance with FIG. 3 essentially in that signal separator 400 is reconfigurable using second selectors 410, 420. In addition, blind source separator 330 may optionally be operated with or without secondary condition within signal separator 400 in accordance with FIG. 4. In other words, a distortion between first microphone signal $x_1$ and first partial signal $y_2$ or between second microphone signal $x_2$ and second partial signal $y_2$ may either be limited or free to take on any value.

It is assumed that in a first configuration state, blind source separator 330 operates with secondary conditions, and that blind source separator 330 outputs, as the first partial signal $y_1$, a signal whose distortions relative to first microphone signal $x_1$ are limited, or reduced, or minimized. In this case, first selector 410 forwards first partial signal $y_1$ as a signal $z_1$ to second selector 420. Second selector 420 subsequently forwards signal $z_1$ as first output signal $a_1$ to the first output. In addition, first selector 410 forwards second partial signal $y_2$ as signal $z_2$ to first adjustable filter 340 and to second adjustable filter 350. Also, selector 2 forwards signal $e_2$ as signal $a_2$ to the second output. The optional all-pass, or delayer, 382 is active in this state, just like second difference former 370. In the operating state described, second adjustable filter 350 forwards signal $z_2$ unchanged to second difference former 370 as signal $y_2''$. In the state mentioned, first difference former 360, first adjustable filter 340 and first all-pass, or delayer, 380 may optionally be deactivated, since signal $e_1$ is not used. Also, second adjustable filter 350 may also be deactivated or bypassed.

In a second operating state, blind source separator 330 is operated with secondary conditions, second partial signal $y_2$ representing the useful signal on the basis of second microphone signal $x_2$. In this case, first selector 410 forwards second partial signal $y_2$ as signal $z_1$ to second selector 420. In the second operating state, second selector 420 forwards signal $z_1$ as second output signal $a_2$ to the second output. In addition, the first selector forwards first partial signal $y_1$, which in the operating state mentioned essentially includes the audio content of the interference signal, as signal $z_2$ to first adjustable filter 340 and to second adjustable filter 350. First adjustable filter 340 preferably forwards signal $z_2$ unchanged so as to obtain signal $y_2'$. In addition, second selector 420 forwards signal $e_1$ as first output signal $a_1$ to the first output. The optional first all-pass, or delayer, 380 and the first difference former 360 are active in the operating state mentioned. Optionally, the second all-pass, or delayer, 382, second difference former 370 and/or second adjustable filter 350 may be deactivated in the second operating state. Also, first adjustable filter 340 may also be deactivated or bypassed.

In a third operating state, blind source separator 330 is operated without secondary condition, first partial signal $y_1$ essentially carrying the audio content of the interference signal. In this case, first selector 410 forwards first partial signal $y_1$ as signal $z_2$ to first adjustable filter 340 and to second adjustable filter 350. The second selector also forwards signal $e_1$ as first output signal $a_2$ to the first output. In addition, second selector 420 forwards signal $e_2$ as second output signal $a_2$ to the second output.

In a fourth operating state, blind source separator 330 is operated without secondary condition, second partial signal $y_2$ essentially describing the audio content of the interference signal. In this case, first selector 410 forwards second partial signal $y_2$ to first adjustable filter 340 and to second adjustable filter 350. Also, the second selector forwards signal $e_1$ as first output signal $a_1$ to the first output, and signal $e_2$ as second output signal $a_2$ to the second output.

Signal separator 400 may thus be adapted as a function of the requirements. Circuitry 400 may further be implemented to be able to take on only one of the operating states mentioned or a subset of the operating states mentioned.

Figure 5:
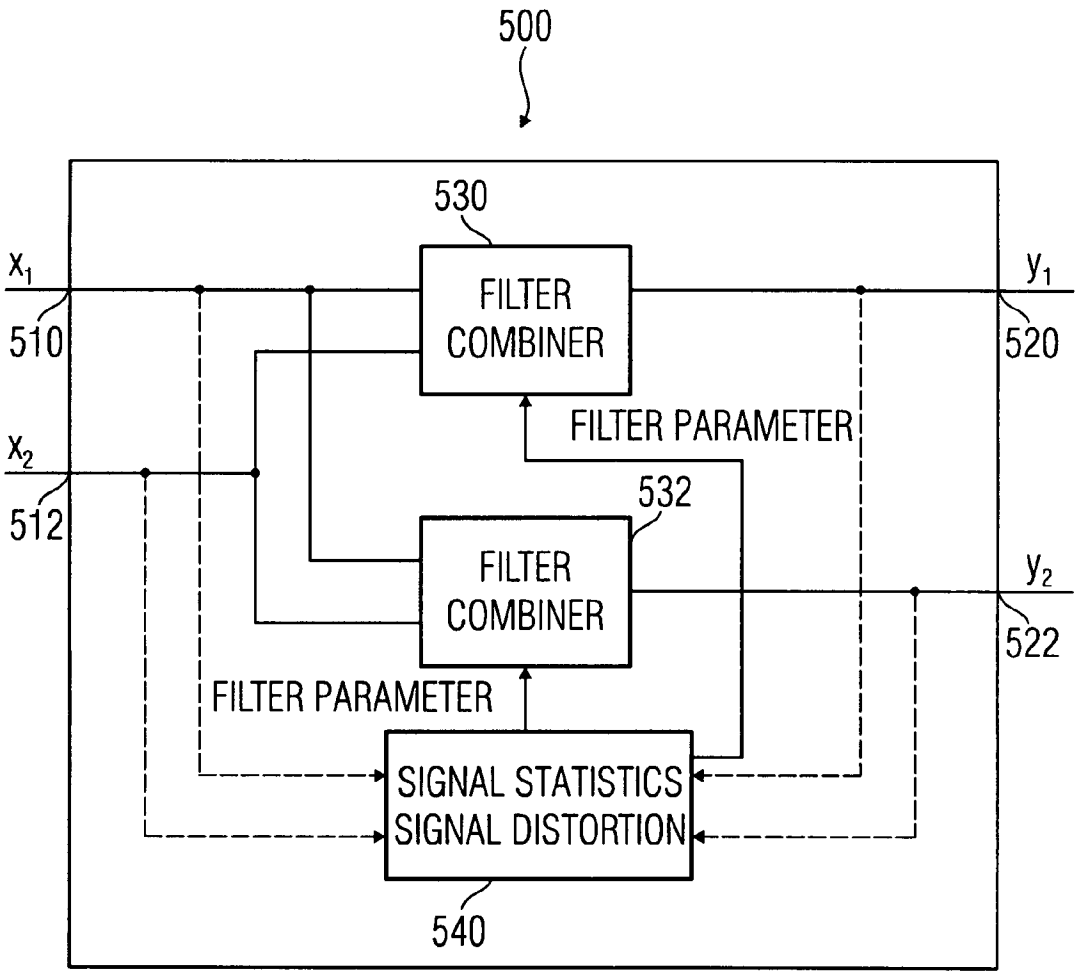
FIG. 5 is a block diagram of a source separator for utilization in an inventive signal separator.

FIG. 5 shows a block diagram of a blind source separator for utilization in the inventive circuitries. The blind source separator in accordance with FIG. 5 is designated by 500 in its entirety. Blind source separator 500 receives, as a first input signal 510, for example first microphone signal $x_1$, and as a second input signal 512, for example second microphone signal $x_2$. Blind source separator 500 is further configured to generate first partial signal $y_1$ as a first output signal 520, and to generate second partial signal $y_2$ as a second output signal 522.

Source separator 500 includes, for example, two filters/combiners 530, 532. For example, first filter/combiner 530 receives first input signal 510 and second input signal 512 and provides first output signal 520. Second filter/combiner 532 also receives first input signal 510 and second input signal 512, and provides second output signal 522. Also, it shall be noted that the two filters/combiners 530, 532 may also be configured in one unit.

Parameter adjuster 540 is implemented to adjust the filter parameters of first filter/combiner 530 and of second filter/combiner 532. To this end, parameter adjuster 540 receives, for example, both input signals 510, 512 and, alternatively or additionally, the two output signals 520, 522. In this context, parameter adjuster 540 is implemented to evaluate, for example, a signal statistic of input signals 510, 512 and/or of output signals 520, 522, and to adjust the filter parameters such that a statistical independence between the two output signals 520, 522 is improved, or optimized, or maximized. In other words, parameter adjuster 540 is implemented, for example, to change the filter parameters in such a direction, or in such a manner that the statistical independence of output signals 520, 522 is improved (increased), or at least not degraded. Optionally, parameter adjuster 540 may additionally also take into account a signal distortion between first input signal 510 and first output signal 520 and/or between second input signal 512 and second output signal 522 so as to adjust, or set, or optimize, the filter parameters such that the signal distortion will not exceed a predefined maximally admissible signal distortion. Thus, filter parameter adjuster 540 may be implemented to achieve a compromise, specified by a cost function, between a statistic independence of output signals 520, 522 and a distortion of output signals 520, 522 relative to input signals 510, 512.

For details with regard to performing blind source separation, please refer to the relevant literature, and particularly to publication [14].

Further details regarding blind source separation are also given in [18]. As a measure of a statistical independence of the output signals, a Kullback-Leibler distance may be used, for example. Alternatively, a maximum entropy, a minimum mutual transinformation, or a negentropy may also be used as measures of the statistical independence. The above-mentioned measures of the statistical independence are described, for example, in [1].

Figure 6:
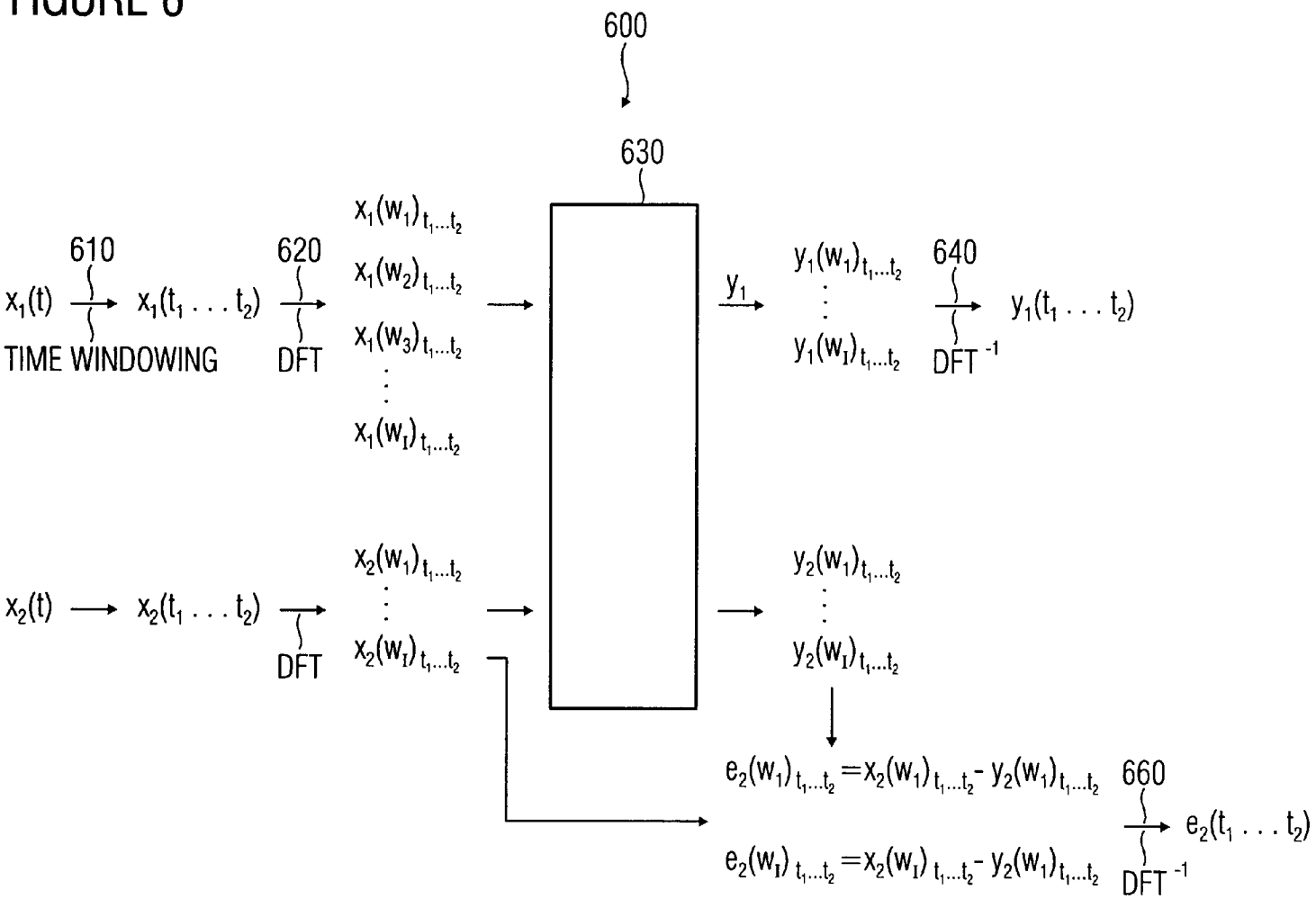
FIG. 6 is a signal flowchart for an inventive signal separator using signals in the frequency domain.

FIG. 6 shows a signal flowchart of an inventive signal separator 100 in accordance with FIG. 1. The signal flowchart in accordance with FIG. 6 is designated by 600 in its entirety and describes a system wherein both source separation and removal of the audio content of the interference source from the second microphone signal are performed using signals within a frequency domain. Microphone signal $x_1(t)$, for example, is subdivided into individual signal segments by means of time-windowing 610. If time signal $x_1(t)$ is present, for example, in the form of samples of a specific sampling rate, a section $x_1(t_1 \ldots t_2)$ may include, for example, a number of N samples between times $t_1$ and $t_2$ (N preferably ranging between 16 and 4,096). Subsequently, a transformation which generates a set of spectral coefficients from the signal section is applied to a section $x_1(t_1 \ldots t_2)$. For example, a discrete Fourier transformation 620 may be employed so as to generate a set of spectral coefficients $x_1(\omega_1)_{t1 \ldots t2}$ to $x_1(\omega_I)_{t1 \ldots t2}$ (I designating the number of different frequency bands, and $\omega_1$ to $\omega_1$ designating the various frequency bands, for example, of a discrete Fourier transformation) from signal section $x_1(t_1 \ldots t_2)$ in the time domain. Analogous processing may also be performed for second microphone signal $x_2(t)$, which initially is present as a time signal, so as to obtain a set of spectral coefficients $x_2(\omega_1)_{t1 \ldots t2}$ to $x_2(\omega_I)_{t1 \ldots t2}$ for a time segment of the second microphone signal.

A blind signal separator 630 receives the first set of spectral coefficients representing first microphone signal $x_1(t)$ within a time segment, and the second set of spectral coefficients representing second microphone signal $x_2(t)$ within a time segment. Blind source separator 630 thus processes the two sets of spectral coefficients and provides partial signals $y_1$, $y_2$, in turn, as two sets of spectral coefficients ($y_1(\omega_1)_{t1 \ldots t2}$ to $y_1(\omega_I)_{t1 \ldots t2}$ and $y_2(\omega_1)_{t1 \ldots t2}$ to $y_2(\omega_I)_{t1 \ldots t2}$). The set of spectral coefficients which describes the first partial signal $y_1$ is converted back to a time signal by means of a transformation. An inverse discrete Fourier transformation 640 may be employed, for example. Thus, first partial signal $y_1$, or output signal $a_1$, is obtained in a time domain (for example between times $t_1$ and $t_2$, or in a different time domain).

In addition, signal $e_1$ may be formed, for example, as a difference between second microphone signal $x_2$ and second partial signal $y_2$. As is shown in FIG. 6, the difference formation may be performed separately for different spectral ranges. The spectral coefficients of signal $e_2$ within a specific time interval which have been obtained in this manner (referred to as $e_2(\omega_1)_{t1 \ldots t2}$ to $e_2(\omega_I)_{t1 \ldots t2}$) are then converted back to a time signal, for example using an inverse discrete Fourier transform 660.

It shall be pointed out that processing in arrangements 200, 300 and 400 may also be fully or partially performed in a spectral range. For example, the configuration of adjustable filters 340 in a spectral range is particularly advantageous, since a filter operation, for example in first adjustable filter 340, comprises only a multiplication of those spectral coefficients which describe signal $z_2$ by associated filter coefficients. Thus, the entire filter processing is divided up into the individual frequency domains, which enables the filter coefficients to be adjusted in a mutually independent manner. Thus, the implementation is simplified substantially in comparison with a time-domain implementation. The individual filter coefficients of adjustable filters 340, 350 may thus be adjusted, for example, in a mutually independent manner.

Details regarding processing within a frequency domain may be seen from, e.g., [2] and [3].

In addition to performing the processing within the frequency domain, processing within a time domain, or mixed processing partly within the time domain and partly in the frequency domain is also possible (cf., e.g., [4]).

Figure 7:
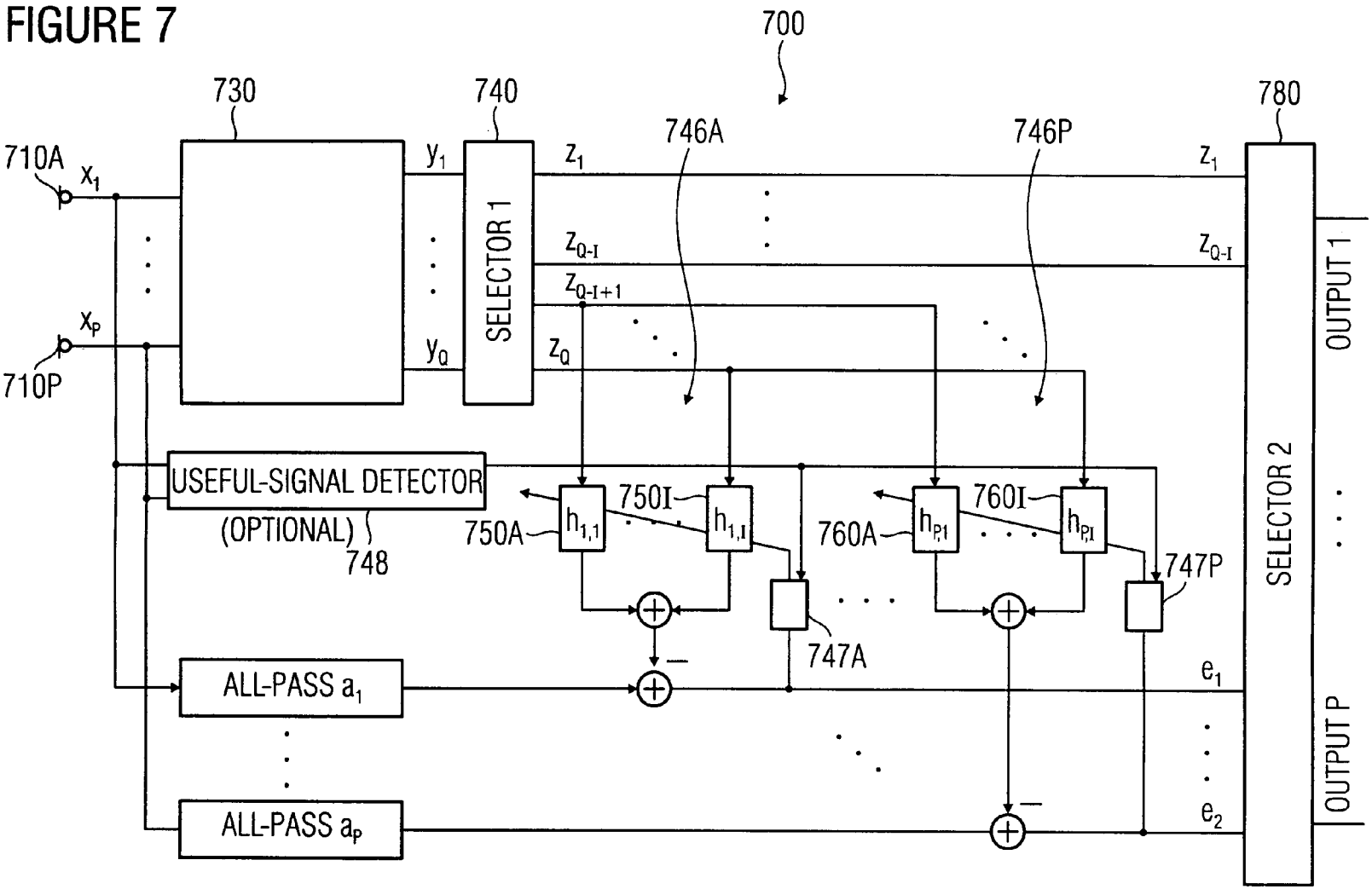
FIG. 7 is a block diagram of an inventive signal separator for removing two or more interference signals from at least two microphone signals, in accordance with a fifth embodiment of the present invention.

FIG. 7 shows a block diagram of an inventive signal separator in accordance with a further embodiment of the present invention. The signal separator in accordance with FIG. 7 is designated by 700 in its entirety. With regard to signal separator 700, it is assumed that P microphone signals of P microphones 710A-710P are available. The microphone signals are designated by $x_1$ to $x_P$. A source separator (or blind source separator) 730 receives the P microphone signals $x_1$ to $x_P$ and generates Q partial signals $y_1$ to $y_Q$, partial signals $y_1$ to $y_Q$ describing audio contents of Q different sources.

In the following, it shall be assumed that it is desired to forward signals of Q−I signal sources to the outputs. In addition, it is assumed that it is desired to mask out the signals from 1 interference sources from the output signals. To this end, a selector 740 is implemented to forward I partial signals of partial signals $y_1$ to $y_Q$ to P blocks of filters 746A-746P. Each of blocks 746A-746P includes I adjustable filters with associated adaptation controllers 747A-747P. For example, a first block 746A comprises I adjustable filters 750A-750I, the $i^{th}$ adjustable filter within one block receiving the $i^{th}$ interference signal (from signals $z_{Q-I+1}$ to $z_Q$) as an input signal to be filtered. The outputs of the I individual adjustable filters of the $p^{th}$ block of filters act upon the $p^{th}$ microphone signal $x_P$. At least one block 746A-746P of the P filter blocks is implemented to remove the I interference signals from the $p^{th}$ microphone signal so as to obtain a signal $e_P$. Each of filter blocks 746A-746P is implemented to distort the I interference signals in an individually adjustable manner, and to subsequently remove the distorted signals from the respective $p.^{th}$ microphone signal (by means of a difference formation). The parameters, or coefficients, of the individual filters for the I interference signals are adjusted (by the associated adaptation controllers 747A-747P) on the basis of the differential signal which arises by removing, or subtracting, the I distorted interference signals from the respective (e.g. $p^{th}$) microphone signal.

Adaptation controllers 747A-747P may also be controlled, for example, via an optional useful-signal detector 748, the useful-signal detector 748 corresponding, in terms of its function, to useful-signal detector 390 in accordance with FIG. 3.

Also, an output selector 780 is implemented to forward the microphone signals (e.g. signals $e_1$-$e_P$), which are freed from interference signals, to the outputs. Alternatively, output selector 780 may also be configured to forward useful signals $z_1$ to $z_{Q-1}$, for example, to the outputs. The useful signals $z_1$ to $z_{Q-I}$ are typically (but not necessarily) directly useable, if the source separator comprises a secondary condition.

Figure 8:
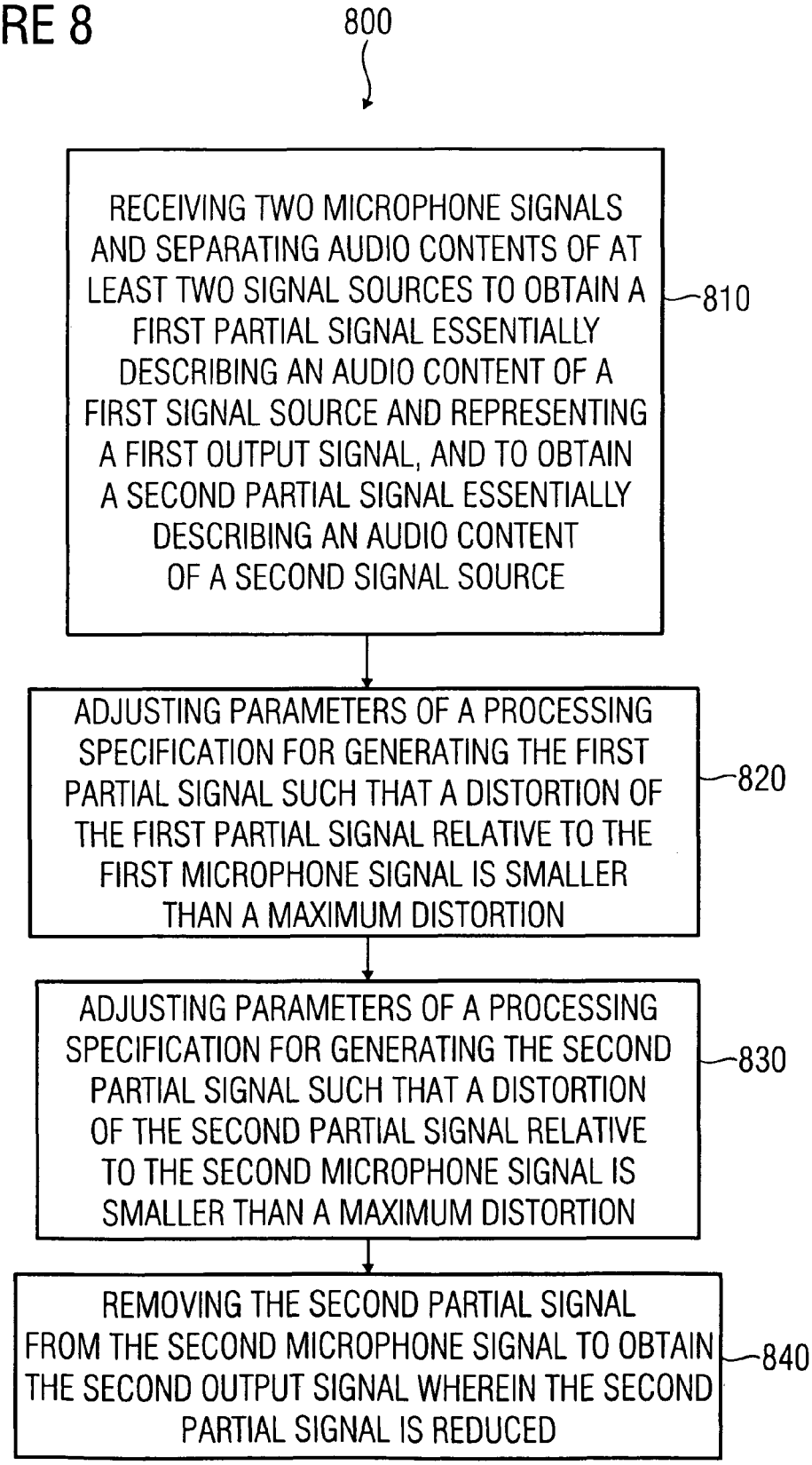
FIG. 8 is a flowchart of a first inventive method in accordance with a sixth embodiment of the present invention.

FIG. 8 shows a flow chart of a first inventive method in accordance with an embodiment of the present invention. The method in accordance with FIG. 8 is designated by 800 in its entirety. The method is suited to determine a first output signal describing an audio content of an useful-signal source in a first microphone signal, and to further determine a second output signal describing an audio content of the useful-signal source in a second microphone signal. In a first step 810, the method includes receiving two microphone signals and separating audio contents of at least two signal sources so as to obtain a first partial signal which essentially describes an audio content of a first signal source, and which represents a first output signal, and to obtain a second partial signal which essentially describes an audio content of a second signal source. In a second step 820, the method comprises adjusting parameters of a processing specification for generating the first partial signal, such that a distortion of the first partial signal relative to the first microphone signal is smaller than a maximum distortion. In addition, in a third step 830, method 800 comprises adjusting parameters of a processing specification for generating the second partial signal, such that a distortion of the second partial signal relative to the second microphone signal is smaller than a maximum distortion. In a fourth step 840, the method further comprises removing a second partial signal from the second microphone signal so as to obtain the second output signal wherein the second partial signal is reduced. Method 800 in accordance with FIG. 8 may also be supplemented by all of those steps which have been illustrated with regard to the inventive device.

Figure 9:
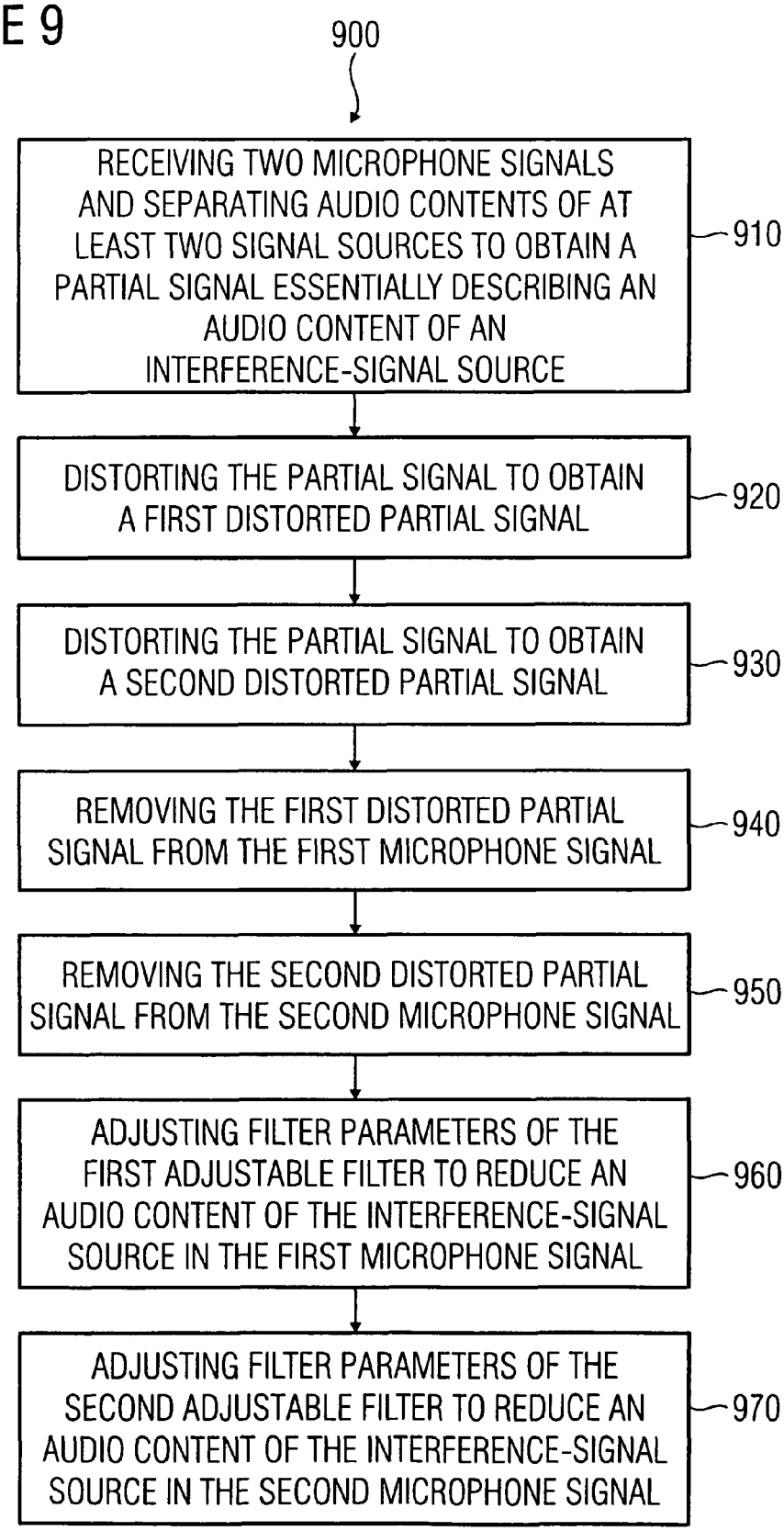
FIG. 9 is a flowchart of a second inventive method in accordance with a seventh embodiment of the present invention.

FIG. 9 shows a flow chart of a second inventive method in accordance with an embodiment of the present invention. The method in accordance with FIG. 9 is designated by 900 in its entirety and serves to determine a first output signal describing an audio content of a useful-signal source in a first microphone signal, and to determine a second output signal describing an audio content of the useful-signal source in a second microphone signal. In a first step 910, method 900 comprises receiving two microphone signals and separating audio contents of at least two signal sources so as to obtain a partial signal essentially describing an audio content of an interference-signal source. In a second step 920, method 900 comprises distorting the partial signal so as to obtain a first distorted partial signal, and in a third step 930, distorting the partial signal so as to obtain a second distorted partial signal. In a fourth step 940, method 900 further comprises removing the first distorted partial signal from the first microphone signal, and in a fifth step 950 removing the second distorted partial signal from the second microphone signal. In a sixth step, method 900 further comprises adjusting filter parameters of the first adjustable filter so as to reduce an audio content of the interference-signal source in the first microphone signal, and in a seventh step 970, adjusting filter parameters of the second adjustable filter so as to reduce an audio content of the interference-signal source in the second microphone signal.

Method 900 in accordance with FIG. 9 may be supplemented by all of those steps which were described with reference to the inventive devices.

Also, the inventive method may be implemented in hardware or in software, depending on the circumstances. The implementation may be effected on a digital storage medium, for example, a disc, CD, DVD, ROM, PROM, EPROM, EEPROM or a flash storage medium, comprising electronically readable control signals, which may interact with a programmable computer system in such a manner that the respective method is performed. Generally, the invention thus also consists in a computer program product comprising a program code, stored on a machine-readable carrier, for performing the inventive method, when the computer program product runs on a computer. In other words, the invention may thus be realized as a computer program comprising a program code for performing the method, when the computer program runs on a computer.

In the following, the core ideas of the present invention will be briefly summarized. To further understanding, the invention will be explained below initially for the case of P=2 sensors and Q=2 source signals. A block diagram of a device, or of a method for P=Q=2 is depicted in FIG. 4. As was described above, blind source separation system (BSS system) 330 forms a first stage, which takes on, at, or from, P=2 sensors $x_1$, $x_2$, a superposition of the Q=2 statistically independent source signals. The blind source separation system (BSS system) 330 ideally provides one of the two signals of the point sources, respectively, at the two outputs, or BSS outputs $y_1$, $y_2$. In realistic application scenarios, in addition to the point-source signal desired in each case, residual portions of the other source signal may be contained therein (in signals $y_1$, $y_2$). In addition, the blind source separation system (BSS system) 330 may typically determine the source signals only up to an any-filtering level of accuracy. By including a secondary condition, which couples, via a measure of distance, inputs $x_1$, $x_2$ and outputs $y_1$, $y_2$ of the BSS system (cf., e.g., [14]), however, one may achieve that the BSS system performs no arbitrary filtering of the separated point source. In this case, the separated source signals $y_1$, $y_2$ ideally correspond to the respective portion in the sensor signal $x_1$ or $x_2$, which stems from first source 320 (source 1) or from second source 322 (source 2) (cf. [14]).

Depending on whether a BSS system 330 comprising or not comprising the above-described secondary condition was selected, the type of post-processing will be different. By means of second selector 420 (selector 2) in accordance with FIG. 4, switching may be effected between the two post-processing techniques, referred to as technique A and technique B below, by means of a suitable selection of the output signals. Technique A requires a BSS system comprising secondary conditions, whereas technique B does not absolutely necessitate a secondary condition.

With both techniques, a decision is initially made in first selector 410 (selector 1) as to whether signal $y_1$ or signal $y_2$ contains the point source desired. The point-source signal desired is then fed to channel $z_1$, and the interference-source signal is fed to channel $z_2$. It is to be noted that in realistic application scenarios, residual portions of the other source signal respectively, will still be present. Techniques A and B shall be explained below:

Technique A

In the event that the point source desired is located in channel $y_1$ (i.e. that channel $y_1$ essentially represents the audio content of the point source desired), first selector 410 (selector 1) will connect channel $y_1$ to $z_1$. On account of the secondary condition (of blind signal separator 330) $z_1$ already contains the correct transfer function describing the propagation from first source 320 (source 1) to the first sensor, or acoustic sensor, or microphone (sensor 1). Thus, $z_1$ may consequently be switched through to the first output (output 1) from second selector 420 (selector 2) (and thus forms first output signal $a_1$).

If the point source desired is located in channel $y_2$, first selector 410 (selector 1) will connect channel $y_2$ to $z_1$. On account of the secondary condition, $z_1$ will in this case contain the transfer function from second source 322 (source 2) to the second sensor, or acoustic sensor, or microphone (sensor 2). This is why second selector 420 (selector 2) in this case will switch channel $z_1$ through to the second output (output 2) (to obtain second output signal $a_2$).

The transfer function from first source 320 (source 1) to the second sensor, or acoustic sensor, or microphone (sensor 2) in the first case is restored within signal $e_2$. In this case, signal $e_2$ is switched through to the second output (output 2) by second selector 420 (selector 2) (to form second output signal $a_2$).

In the second case, the transfer function from second source 322 (source 2) to the first sensor, or acoustic sensor, or microphone (sensor 1) is required. Said transfer function is restored within signal $e_1$. Subsequently, signal $e_1$ is switched through to the first output (output 1) by second selector 420 (selector 2) (to form first output signal $a_1$).

Signals $e_1$ and $e_2$ are generated in that signal $z_2$ (which contains the interference signal) is connected to adaptive filters 340 (also referred to as $h_1$) and 350 (also referred as $h_2$), and is subsequently subtracted from the reference signals. By means of the reference signals, sensor signals $x_1$ and $x_2$, respectively, which are processed by means of all-passes 380 (also referred to as all-pass $a_1$) and 382 (also referred to as all-pass $a_2$), respectively, are also incorporated. As special cases, all-passes 380 (all-pass $a_1$) and 382 (all-pass $a_2$) may also be selected as pure delay units.

The adaptive filtering technique in accordance with [12], which was already described above, is used for adapting filters 340 ($h_1$), 350 ($h_2$). In other words, output channels of a multichannel source separation system are connected to one-channel adaptive filters in each case, which incorporate delayed microphone signals as reference signals. Adaptive, partially discrete filters represent a wide-spread technique in digital signal processing [12]. The principle of an adaptive filter is to determine filter coefficients in such a manner that the output signal of the system or of the adaptive filter is approximated to a reference signal, given a known input signal (cf., e.g., [12]). This may be achieved, for example, in that an error signal $e_p$ (n) is minimized in accordance with a specific criterion (typically in accordance with a mean square error). For example, the following may apply to the error signal:

$$e_1(n)=x_1'(n)-y_2'(n),$$

wherein n describes, for example, a moment of a sample, or of a time interval, and wherein it is possible for the mean square error (i.e. the mean power or energy of error signal $e_P$, or $e_1$) should be determined, for example, by averaging over time and/or frequency.

In signals $e_1$, $e_2$ the undesired point source is thus suppressed. Due to the fact that the sensor signals (or signals derived therefrom by all-passes 380, 382) are used as reference signals ($x_1'$, $x_2'$), both the point source desired in each case and the point source suppressed are represented in a spatially correct manner in signals $e_1$, $e_2$. Also, due to the fact that one reference signal in each case is generated by the sensor signals, efficient algorithms for monitored adaptive filtering may be used for adapting filters 340 ($h_1$), 350 ($h_2$).

In contrast to technique B, which will be described below, adaptive filters 340 ($h_1$) and 350 ($h_2$) may be replaced, in technique A, by a constant factor of 1 (i.e. may be dispensed with). This special case, which is relevant for practical application, results in a simplification of the system. Along with a possible simplification of all-passes 380 (all-pass $a_1$) and 382 (all-pass $a_2$) as pure delay units, two new block diagrams thus result.

FIG. 1 depicts a simplified system in the event that the desired source signal is located in $y_2$, i.e. in the event that the first selector 410 (selector 1) connects BSS output $y_2$ to $z_1$. In other words, the source signal, or useful source signal, will appear at BSS output $y_2$, whereas the interference-source signal will appear at BSS output $y_1$.

FIG. 2 depicts a simplified system in the event that the desired source signal is located in $y_1$, i.e. in the event that the first selector 410 (selector 1) connects BSS output $y_1$ to $z_1$. In other words, the source signal, or useful source signal, will appear at BSS output $y_1$. However, the interference-source signal will appear at BSS output $y_2$.

Technique B

With technique B, the secondary condition, in relation to the BSS system, or in relation to the blind channel estimator, is not mandatory, but is optional. Therefore, one cannot assume that signals $y_1$ and $y_2$ contain the transfer functions of the two sources 320, 322 (source 1, source 2) to the sensors, or acoustic sensors, or microphones (sensor 1, sensor 2). For this reason, with technique B, second selector 420 (selector 2) switches signal $e_1$ through to the first output (output $a_1$) as first output signal $a_1$, and further switches signal $e_2$ through to the second output (output 2) as second output signal $a_2$ (cf. FIG. 4).

An expansion of the invention to a BSS system (or system for blind source separation) with P sensors and Q point sources is depicted in FIG. 7. The number of interference sources is designated by I. This results in Q−1 point sources desired. BSS system 700 provides Q separate sources, the Q−I desired point sources being associated to channels $z_1$ to $z_{Q-I}$ by first selector 740 (selector 1). The interference sources are associated with channels $z_{Q-I+1}$ to $z_Q$ by first selector 740 (selector 1). Channels $z_{Q-I+1}$ to $z_Q$ are connected to adaptive filters $h_{i,1}$ to $h_{i,1}$ (i=1, P) and are subtracted from the reference signals. In other words, channels $z_{Q-I+1}$ to $z_Q$ are distorted by adaptive filters $h_{i,1}$ to $h_{i,1}$, and the signal distorted is subtracted from the reference signals, i.e., for example, from the all-pass filtered microphone signals $x_1$ to $x_P$. By means of the reference signals, sensor signals $x_1$, $x_P$, which are revised by means of all-passes all-pass $a_1$, . . . all-pass $a_P$, are thus incorporated, respectively. As a special case, all-passes all-pass $a_1$, . . . , all-pass $a_P$ may again be selected as pure delay units. In this manner, signals $e_1$, . . . , $e_P$ are generated, wherein all Q−1 desired point sources are suppressed. Due to the fact that the sensor signals (or all-pass filtered sensor signals) are used as reference signals, both the point sources desired, and the point sources suppressed, respectively, are represented in a spatially correct manner in signals $e_1$, . . . , $e_P$.

With technique A, again, a BSS comprising secondary conditions is preferably selected. On the basis of the transfer functions containing the desired point sources in signals $z_1$, $z_w$, signals $z_1$, . . . , $z_w$ will then be switched through to the respective output channels by second selector 780 (selector 2). This means that a potential permutation of the BSS output signals, which was taken into account by first selector 740 (selector 1), must also be taken into account by second selector 780 (selector 2). The selection of the connections of channels $z_1$, . . . , $z_{Q-I}$ to outputs 1, . . . , P performed by selector 2 was discussed in detail above for the event that P=Q=2, and is conducted in analogous manner at this point. The remaining P−Q+I output signals are determined from signals $e_1$, . . . , $e_P$.

With technique B, the secondary condition in the BSS system (i.e., for example, in blind source separator 730) is not mandatory. This is why, here, signals $e_1$, . . . , $e_P$ are connected through to outputs 1, . . . , P.

In the following, several observations will be illustrated with regard to a practical implementation of the present invention. The invention described here was verified for acoustic signals by means of simulations. To this end, the signals of two point sources (voice signals) were recorded in a reverberant room by means of two microphones. Here, one of the signals represents the point source desired, the other signal represents the interference source. The microphone signals are processed by a BSS algorithm, which will provide, after a short convergence time, the desired voice signal along with a small residual portion of the interference signal, at one of the two BSS output channels. The other BSS output will provide the interference signal along with a small residual portion of the point source desired. First selector (selector 1) passes the BSS output signal, which includes the interference source, to adaptive filters $h_{1,1}$ and $h_{2,1}$. Thus, a spatially correct representation of the point source desired as well as of the residual portion of the interference source is achieved at outputs $e_1$ and $e_2$ of the post-processing block.

Both technique A and technique B were tested by means of simulations. With both techniques, it was possible to achieve a spatially correct representation of the point source desired and of the interference source. The two channels may be listened to by a stereo reproduction system, i.e. a headset.

In summary, one may thus establish that the present invention provides a system for restoring spatial information in blind source separation systems. Conventional blind source separation systems determine, in each output channel, a one-channel estimation of the point source desired in each case, along with residual portions of the interference sources which may be present, from the mixes of signals at the sensors (or acoustic sensors or microphones). The present invention provides a post-processing block to restore the spatial information both from the point source desired and from the interference sources which may still be present. To determine the output signals of the post-processing block, the sensor signals (or microphone signals) are utilized along with the output signals of the blind source separation (e.g. signals $y_1$, $y_2$, . . . , $y_Q$). The majority of similar concepts, which are already known from the literature, only achieve a spatial representation of the source desired, so that any interference sources which may still be present are also mapped to this point.

Thus, an essential concept, or a motivation of the present invention is to restore spatial information (i.e. information about a spatial location of point sources) at the output in that the original sensor signals are also processed in a new post-processing block along with the output signals of the BSS.

In summary, one may thus establish that the present invention provides a signal separator which enables effective removal of interference sources from a multichannel audio signal, any remaining residual portions of the interference sources being mapped to their original spatial positions. The present invention also enables a realization at comparatively low expenditure.

BIBLIOGRAPHY

[1] A. Hyvärinen, J. Harhunen und E. Oja, *Independent Component Analysis*, Wiley & Sons, New York, 2001.

[2] L. Parra und C. Spence, *Convolutive Blind Source Separation of Non-stationary Sources*, IEEE Trans. Speech an Audio Processing, pp. 320-327, May 2000.

[3] European Patent EP 1070390 B1, L. Parra und C. Spence: *Convolutive Blind Source Separation Using a Multiple Decorrelation Method*, European Patent Specification 1070390 B1, date of filing: Apr. 8, 1999, claiming priority of Apr. 8, 1998, published Jun. 22, 2005, patent category (IPC) H03H 21/00.

[4] H. Buchner, R. Aichner und W. Kellermann, *Blind Source Sepaaration for Convolutive Mixtures: A Unified Treatment*, in Y. Huang, J. Benesty (editors) *Audio Signal Processing*, Kluwer Academic Publishers, Boston, 2004.

[5] T. Hoya, T. Tanaka, A. Cichicki, T. Murakami, G. Hori und J. Chambers, *Stereophonic Noise Reduction Using a Combined Sliding Subspace Projection an Adaptive Signal Enhancement*, IEEE Trans. Speech an Audio Processing, vol. 13, No. 3, pp. 309-320, May 2005.

[6] J. Allen und D. Berkley, *Image Method for Efficiently Simulating Small-Room Acoustics*, J. Acoust. Soc. Am., pp. 943-950, 1979.

[7] J. Garas, *Adaptive 3D Sound Systems*, Kluwer Academic Publishers, 2000.

[8] Patent WO2004/006624 AI, E. Schaeffer: Sound Source Spatialization System, date of filing: Jun. 27, 2003, claiming priority of Jul. 2, 2002, published Jan. 15, 2004, patent category (IPC) H04S 1/00.

[9] Herbert Buchner, Robert Aichner und Walter Kellermann, *Relation between Blind System Identification and Convolutive Blind Source Separation, Hands-free Speech Communication and Microphone Arrays* Workshop, Piscataway, N.J., USA, 2005.

[10] Herbert Buchner, Robert Aichner, Jochen Stenglein, Heinz Teutsch und Walter Kellermann, *Simultaneous Localization of Multiple Sound Sources using Blind Adaptive MIMO Filtering*, Proc. IEEE Int. Conf. on Acoustics, Speech, and Signal Processing (ICASSP), Philadelphia, USA, March, 2005.

[11] R. Martin, *Noise Power Spectral Density Estimation Based on Optimal Smoothing and Minimum Statistics*, IEEE Trans. Speech and Audio Processing, vol. 9, No. 5, pp. 504-512, July, 2001

[12] S. Haykin, Adaptive Filter Theory, 4th edition, Prentice-Hall, 2002.

[13] T. Takatani, T. Nishikawa, H. Saruwatari und K. Shikano, *High-Fidelity Blind Separation of Acoustic Signals using SIMO-Model-Based ICA with Information-Geometric Learning*, Proc. Int. Workshop on Acoustic Echo and Noise Control (IWAENC), September 2003, Kyoto, Japan.

[14] K. Matsuoka und S. Nakshima, *Minimal Distortion Principle for Blind Source Separation*, Proc. Int. Conf. on Independent Component Analysis and Blind Signal Separation, December 2001, San Diego, Calif., USA.

[15] T. J. Klasen, M. Moonen, T. Van den Bogaert und J. Wouters, "*Preservation of interaural time delay for binaural hearing aids through multi-channel Wiener filtering based noise reduction*", Proc. IEEE Int. Conf. on Acoustics, Speech, and Signal Processing (ICASSP), Philadelphia, USA, March 2005.

[16] W. Herbordt, F. Nakamura, W. Kellermann "Multi-channel estimation of power spectral density of noise for mixtures of non-stationary signals", IPSJ SIG Technical Reports, vol. 2004, no. 131, pp. 211-216, Kyoto, Japan, December 2004

[17] W. Herbordt. T. Trini, W. Kellermann "Robust spatial estimation of the signal-to-interference ratio for non-stationary mixtures", Proc. Int. Workshop on Acoustic Echo and Noise Control, pp. 247-250, Kyoto, Japan, September 2003

[18] Herbert Buchner, Robert Aichner, Walter Kellermann "TRINICON: A Versatile Framework for Multichannel Blind Signal Processing", Proc. IEEE Int. Conf. On Acoustics, Speech and Signal Processing (ICASSP), pp. 889-892, vol. 3, Montreal, Canada, May 2004

[19] S. Ikeda, N. Murata, "A method of ICA in time-frequency domain", in Proc. Int. Symposium on Independent Component Analysis and Blind Signal Separation, pp. 365-371, Aussois, France, January 1999

The invention claimed is:

1. A signal separator for determining a first output signal describing an audio content of a useful-signal source in a first microphone signal, and for determining a second output signal describing an audio content of the useful-signal source in a second microphone signal, comprising:

a source separator receives the two microphone signals from two acoustic sensors located in a room to receive audio signals from signal sources located in the room and to separate audio contents of at least two signal sources, the source separator obtains a first partial signal essentially describing an audio content of a first signal source, and represents the first output signal, and so as to obtain a second partial signal essentially describing an audio content of a second signal source;

the source separator adjusts parameters of a processing specification for generating the first partial signal from the microphone signals such that a distortion of the first partial signal relative to the first microphone signal is smaller than a maximum distortion, and adjusts parameters of a processing specification for generating the second partial signal from the microphone signals such that a distortion of the second partial signal relative to the second microphone signal is smaller than a maximum distortion; and a signal remover removes the second partial signal from the second microphone signal in order to obtain the second output signal, wherein the second partial signal is reduced.

2. The signal separator as claimed in claim 1, wherein the source separator separates the audio contents of the signal sources on the basis of their spatial locations in the room or on the basis of their statistical properties.

3. The signal separator as claimed in claim 1, wherein the source separator determines the parameters of the processing specification for generating the first partial signal as a function of a measure of the distortion of the first partial signal relative to the first microphone signal, to set an upper limit to the distortion of the first partial signal relative to the first microphone signal, and wherein the source separator determines the parameters of the processing specification for generating the second partial signal as a function of a measure of the distortion of the second partial signal relative to the second microphone signal, to set an upper limit to the distortion of the second partial signal relative to the second microphone signal.

4. The signal separator as claimed in claim 1, wherein the source separator determines the parameters of the processing specifications for generating the first partial signal and the second partial signal by optimization while using a cost function, the cost function includes a measure of a statistical independence between the partial signals, a measure of a distortion between the first microphone signal and the first partial signal, and a measure of a distortion between the second microphone signal and the second partial signal, wherein the optimization achieves a compromise, determined by the cost function, between as large as possible a statistical independence of the partial signals, as small as possible a distortion between the first microphone signal and the first partial signal, and as small as possible a distortion between the second microphone signal and the second partial signal.

5. The signal separator as claimed in claim 4, wherein the measure of the statistical independence between the first partial signal and the second partial signal is based on a determination of a Kullback-Leibler distance, a maximum entropy, a minimal transinformation and/or a negentropy.

6. The signal separator as claimed in claim 4, wherein the cost function takes into account a non-Gauss-condition, a non-whiteness and/or a non-steady-state condition of probability density functions of the partial signals.

7. The signal separator as claimed in claims 3, wherein the measure of the distortion between the first microphone signal and the first partial signal is a magnitude or a norm of a difference between values of the first microphone signal and the first partial signal, and wherein the measure of the distortion between the second microphone signal and the second partial signal is a magnitude or a norm of a difference between values of the second microphone signal and the second partial signal.

8. The signal separator as claimed in claim 1, wherein the signal remover includes a delay unit that delays the second microphone signal in order to balance off a processing duration when determining the second partial signal, and obtains a delayed second microphone signal, and a difference former determines the second output signal as a difference between the delayed second microphone signal and the second partial signal.

9. The signal separator as claimed in claim 1, wherein the signal separator represents the first microphone signal, the second microphone signal, the first partial signal and/or the second partial signal by a plurality of signal portions in a plurality of audio frequency domains, so as to separate the audio contents of the at least two signal sources on the basis of an analysis in a spectral range and to remove the second partial signal from the second microphone signal by forming a difference for a plurality of signal portions in a plurality of audio frequency domains.

10. The signal separator as claimed in claim 1, wherein the first signal source forms the useful-signal source.

11. The signal separator as claimed in claim 1, wherein the source separator separates signal portions of two signal sources so as to recognize which of the two signal sources is a useful-signal source, and which of the two signal sources is an interference-signal source, and to output the audio content of the useful-signal source as the first partial signal, and to output the audio content of the interference-signal source as the second partial signal.

* * * * *